US011629479B2

(12) United States Patent
Nakajima et al.

(10) Patent No.: US 11,629,479 B2
(45) Date of Patent: Apr. 18, 2023

(54) HYDRAULIC CONTROL CIRCUIT FOR A CONSTRUCTION MACHINE

(71) Applicant: Caterpillar SARL, Geneva (CH)

(72) Inventors: Hideki Nakajima, Akashi (JP); Koichi Kiyasu, Akashi (JP)

(73) Assignee: Caterpillar SARL, Geneva (CH)

( * ) Notice: Subject to any disclaimer, the term of this patent is extended or adjusted under 35 U.S.C. 154(b) by 21 days.

(21) Appl. No.: 17/413,831

(22) PCT Filed: Dec. 11, 2019

(86) PCT No.: PCT/EP2019/025453
§ 371 (c)(1),
(2) Date: Jun. 14, 2021

(87) PCT Pub. No.: WO2020/119947
PCT Pub. Date: Jun. 18, 2020

(65) Prior Publication Data

US 2022/0064903 A1 Mar. 3, 2022

(30) Foreign Application Priority Data

Dec. 13, 2018 (JP) ..... JP2018-233210

(51) Int. Cl.
*E02F 9/22* (2006.01)
*F15B 13/02* (2006.01)
(Continued)

(52) U.S. Cl.
CPC ..... *E02F 9/2228* (2013.01); *E02F 9/2217* (2013.01); *E02F 9/2267* (2013.01);
(Continued)

(58) Field of Classification Search
CPC ..... F15B 2211/3133; F15B 2211/024; F15B 2211/3058; F15B 13/02; E02F 9/2292
See application file for complete search history.

(56) References Cited

U.S. PATENT DOCUMENTS 11,162,245 B2 * 11/2021 Nakajima ..... F15B 11/024
2006/0162543 A1 * 7/2006 Abe ..... E02F 9/2239 91/418

(Continued)

FOREIGN PATENT DOCUMENTS

EP 0104613 A2 4/1984
JP 5778086 B2 9/2015

(Continued)

OTHER PUBLICATIONS

International Search Report related to PCT Application No. PCT/EP2019/025453 dated Jun. 9, 2020.

*Primary Examiner* — Abiy Teka

(57) ABSTRACT

To make it possible to control supply, discharge, and recycled flow rates independently of each other for the stick cylinder in a construction machine comprising first and second stick spool valves respectively connected to first and second hydraulic pumps. [Solution] A poppet valve is provided at upstream side of the first stick spool valve for controlling a supply flow rate from first hydraulic pump, the first stick spool valve is configured to supply hydraulic flow from the poppet valve to the stick cylinder without restricting the flow, and when the stick cylinder is extended, the poppet valve is configured to control supply flow rate from the first hydraulic pump to head side oil chamber, the first stick spool valve is configured to control recycled flow rate from a rod side oil chamber to the head side oil chamber, and the second stick spool valve is configured to control the supply flow rate from second hydraulic pump to head side oil chamber and the discharge flow rate from the rod side oil chamber to an oil tank.

6 Claims, 12 Drawing Sheets

(51) Int. Cl.
*F15B 15/20* (2006.01)
*E02F 3/42* (2006.01)

(52) U.S. Cl.
CPC ..... *E02F 9/2285* (2013.01); *E02F 9/2292* (2013.01); *F15B 13/02* (2013.01); *F15B 15/20* (2013.01); *E02F 3/425* (2013.01); *F15B 2211/405* (2013.01)

(56) References Cited

U.S. PATENT DOCUMENTS

| | | | | |
|---|---|---|---|---|
| 2012/0260637 | A1* | 10/2012 | Sato ..... | E02F 9/2292 60/285 |
| 2014/0283676 | A1* | 9/2014 | Beschorner ..... | E02F 9/2292 91/418 |
| 2018/0016770 | A1* | 1/2018 | Honda ..... | E02F 9/2296 |

FOREIGN PATENT DOCUMENTS

| | | | |
|---|---|---|---|
| JP | 2016145592 | A | 8/2016 |
| JP | 2017020604 | A | 1/2017 |
| WO | 0055509 | A1 | 9/2000 |
| WO | 2010026678 | A1 | 3/2010 |

* cited by examiner

HYDRAULIC CONTROL CIRCUIT FOR A CONSTRUCTION MACHINE

This patent application is a 35 USC § 371 U.S. national stage of International Application No. PCT/EP2019/025453 filed on Dec. 11, 2019, which claims the benefit and priority of Japanese Application No. 2018-233210 filed on Dec. 13, 2018, the disclosures of which are incorporated in their entirety by reference herein.

FIELD OF THE INVENTION

The present invention relates to a technical field of hydraulic control circuit used in construction machines such as a hydraulic excavator.

BACKGROUND ART

In general, some construction machines, such as a hydraulic excavator for example, have a stick longitudinally swingably supported at an end part of a boom vertically movably supported by a body and are configured to swing the stick with expansion and contraction operations of a stick cylinder. As for hydraulic control circuit for these construction machines, first and second hydraulic pumps are installed as hydraulic pressure supply sources for multiple hydraulic actuators to be installed in these construction machines, and as for hydraulic actuator, such as the stick cylinder mentioned above for example, that needs a large flow rate corresponding to each work content, in order to enable pressure oil supply from both first and second hydraulic pumps, a circuit equipped with first and second spool valves connected to each of first and second hydraulic pumps has been ever widely used for controlling oil supply and discharge for hydraulic actuators (refer to FIG. 3 in PTL 1, for example).

Now, the spool valve mentioned above to be installed in conventional hydraulic control circuit for construction machine is configured to conduct a direction change-over control for changing over hydraulic oil supply/discharge direction for hydraulic actuator, a supply flow control for controlling supply flow rate from hydraulic pump to hydraulic actuator, and a discharge flow control for controlling discharge flow rate from hydraulic actuator to hydraulic pump simultaneously, so an opening areas for oil supply and oil discharge are uniquely determined according to a moved position of the spool valve. Furthermore, when recycling drain oil from one oil chamber in hydraulic actuator to another in order to reduce fuel consumption and when the spool valve mentioned above is to be used to control recycled flow rate as well, an opening area for oil recycle will be uniquely determined according to the moved position of the spool valve. Therefore, a relationship among a supply flow rate, discharge flow rate, and further recycled flow rate cannot be changed according to the content of various works, such as a stand-alone work to drive a stick cylinder alone, compound work to drive other hydraulic actuator as well, light load work, and heavy load work, for example, impeding an improvement of efficiency and operability. However, in particular, a stick operation by expanding and contracting the stick cylinder is a highly frequent manipulation in construction machine including hydraulic excavator and the stick cylinder is often operated in combination with other hydraulic actuator, so it is required to improve efficiency and operability of manipulation.

Therefore, in the PTL 1, a control valve is installed for controlling pressure oil amount to be supplied to the first and second spool valves at upstream side of first and second spool valves controlling oil supply and discharge for the stick cylinder. In this case, the control valve enables to change pressure oil supply amount to be supplied from first and second spool valves to stick cylinder according to the work content and others by changing pressure oil amount to be supplied to first and second spool valves even if the moved position of spool valve is a same.

Meanwhile, some technique controls supply and discharge flow rates for the hydraulic actuator with each valve individually by providing a flow control valve for controlling the supply flow rate from the hydraulic pump to the hydraulic actuator and a direction change-over valve arranged at a downstream side of the flow control valve for changing over a supply/discharge direction of hydraulic oil to the hydraulic actuator and controlling the discharge flow rate from the hydraulic actuator (refer to PTL 2, for example).

CITATION LIST

Patent Document

PTL 1: U.S. Pat. No. 5,778,086

PTL 2: Japanese Unexamined Patent Application Publication No. 2017-20604

SUMMARY OF INVENTION

Problem to be Solved by the Invention

However, in the PTL 1, a supply valve passage (second internal passage), which is installed in the spool valve in order to supply pressure oil to the stick cylinder, is configured to change the flow rate according to the spool position and a control unit for controlling the control valve is configured to satisfy opening areas of control valve and spool valve are the same extent as the opening of conventional spool. That is, since the control valve and spool valve installed in series with each other are configured to control the supply flow rate respectively when supplying delivery oil from hydraulic pump to stick cylinder, the control is complicated and it is hard to control the flow rate accurately.

Meanwhile, in PTL 2, since the flow control valve only controls the supply flow rate to the hydraulic actuator and a direction control valve does not control the supply flow rate, so that this configuration will not cause the same problem as that of PTL 1. However the PTL 2 has a configuration that first and second hydraulic pumps are provided as a hydraulic supply source for the stick cylinder, only one spool valve (direction change-over valve) is installed for the stick cylinder, and the flow rate of delivery oil from first and second hydraulic pumps is controlled with the flow control valve and then the delivery oil is merged to be supplied to the spool valve. Therefore, there are problems that the conventional circuit mentioned above, i.e., a circuit equipped with first and second spool valves connected to each of first and second hydraulic pumps for controlling oil supply/discharge of the stick cylinder, cannot be used as is, a new spool valve may be required in accordance with total flow rate from first and second hydraulic pumps, and a valve unit with a new circuit configuration needs to be manufactured, thereby causing higher cost.

In addition, as for a recycled flow control mentioned above, it has been requested to control the flow rate independently of supply/discharge flow controls by using the spool valve without using dedicated recycle valve separately; these are challenges to be solved by this invention.

Means for Solving the Problem

The present invention is created to solve these challenges; the invention of claim 1 is a hydraulic control circuit for a construction machine, comprising: a boom being vertically movably supported by a body and a stick swingably supported at an end part of the boom; first and second hydraulic pumps configured to swing the stick in dependence upon extension and contraction operations of a stick cylinder and used as hydraulic supply source; and first and second stick spool valves being connected respectively to the first and second hydraulic pumps and controlling oil supply and discharge for the stick cylinder; wherein, a poppet valve is provided at upstream side of the first spool valve for controlling a supply flow rate from the first hydraulic pump to the first stick spool valve, the first stick spool valve is configured to supply hydraulic flow to the stick cylinder without increasing or decreasing a flow rate from the poppet valve, and when the stick cylinder is extended, the poppet valve is configured to control supply flow rate from first hydraulic pump to head side oil chamber of the stick cylinder, the first stick spool valve is configured to control a recycled flow rate from rod side oil chamber of the stick cylinder to the head side oil chamber, the second stick spool valve is configured to control supply flow rate from second hydraulic pump to head side oil chamber of the stick cylinder and discharge flow rate from rod side oil chamber to an oil tank.

The invention of claim 2 is the hydraulic control circuit for a construction machine of claim 1, wherein, when the stick cylinder is contracted, the poppet valve is configured to control a supply flow rate from first hydraulic pump to a rod side oil chamber of stick cylinder, the first stick spool valve is configured to control discharge flow rate from head side oil chamber of stick cylinder to oil tank, and the second stick spool valve is configured to control the supply flow rate from second hydraulic pump to the rod side oil chamber of stick cylinder and the discharge flow rate from head side oil chamber to oil tank.

The invention of claim 3 is a hydraulic control circuit for a construction machine, comprising: a boom being vertically movably supported by a body and a stick swingably supported at an end part of the boom; first and second hydraulic pumps configured to swing the stick in dependence upon extension and contraction operations of a stick cylinder and used as hydraulic supply source; and first and second stick spool valves being connected respectively to the first and second hydraulic pumps and controlling oil supply and discharge for the stick cylinder; wherein, first and second poppet valves are provided at upstream side of the first and second spool valves for controlling each supply flow rate from first and second hydraulic pumps to first and second stick spool valves, the first and second stick spool valves are configured to supply hydraulic flow to the stick cylinder without increasing or decreasing a flow rate from first and second poppet valves, and when the stick cylinder is extended, the first and second poppet valves are configured to control supply flow rate from first and second hydraulic pumps to head side oil chamber of the stick cylinder, the first stick spool valve is configured to control a recycled flow rate from rod side oil chamber of the stick cylinder to head side oil chamber, and the second stick spool valve is configured to control discharge flow rate from rod side oil chamber of the stick cylinder to oil tank.

The invention of claim 4 is the hydraulic control circuit for a construction machine of claim 3, wherein, when the stick cylinder is contracted, the first and second poppet valves are configured to control supply flow rate respectively from first and second hydraulic pumps to the rod side oil chamber of stick cylinder, the first stick spool valve is configured to control discharge flow rate from head side oil chamber of stick cylinder to oil tank, and the second stick spool valve is configured to control discharge flow rate from head side oil chamber of stick cylinder to oil tank.

The invention of claim 5 is the hydraulic control circuit for a construction machine of any of claims 1 to 4, providing a means to determine whether it is possible to recycle hydraulic oil from rod side oil chamber to head side oil chamber based on a pressure in rod side and head side oil chambers during an extension of stick cylinder, wherein, when it is determined impossible to recycle hydraulic oil by the determination means, the first stick spool valve is configured to control discharge flow rate from rod side hydraulic oil chamber to oil tank.

The invention of claim 6 is the hydraulic control circuit for a construction machine of any of claims 1 to 5, comprising first and second bypass valves respectively controlling a flow rate of first and second bypass oil passages for feeding delivery oil of first and second hydraulic pumps to oil tank.

Effects of the Invention

According to the invention of claim 1, supply, recycle, and discharge flow rates for the stick cylinder can be controlled independently of each other by using first and second stick spool valves during the stick cylinder extension, thereby contributing high efficiency and improvement of operability and attaining cost suppression.

According to the invention of claim 2, even when the stick cylinder is contracted, supply/discharge flow rates for the stick cylinder can be controlled independently of each other by using first and second stick spool valves.

According to the invention of claim 3, when the stick cylinder is extended, the supply flow rate can be more accurately controlled.

According to the invention of claim 4, even when the stick cylinder is contracted, the supply flow rate can be more accurately controlled.

According to the invention of claim 5, when recycling is impossible during the stick cylinder extension, an operation speed of the stick cylinder can be prevented surely from being slowed down.

According to the invention of claim 6, the delivery flow rate of first and second hydraulic pumps can be controlled accurately.

BRIEF DESCRIPTION OF THE DRAWINGS

FIG. 3 is a drawing illustrating opening characteristics of first and second boom spool valves according to the first embodiment.

FIG. 4 is a drawing illustrating opening characteristics of first and second stick spool valves according to the first embodiment.

FIG. 8 is a drawing illustrating opening characteristics of second stick spool valve according to second embodiment.

FIG. 10 is a drawing illustrating opening characteristics of first stick spool valve according to third embodiment.

DESCRIPTION OF EMBODIMENT

Now, an explanation is provided below about embodiments of the present invention based on drawings.

Figure 1:
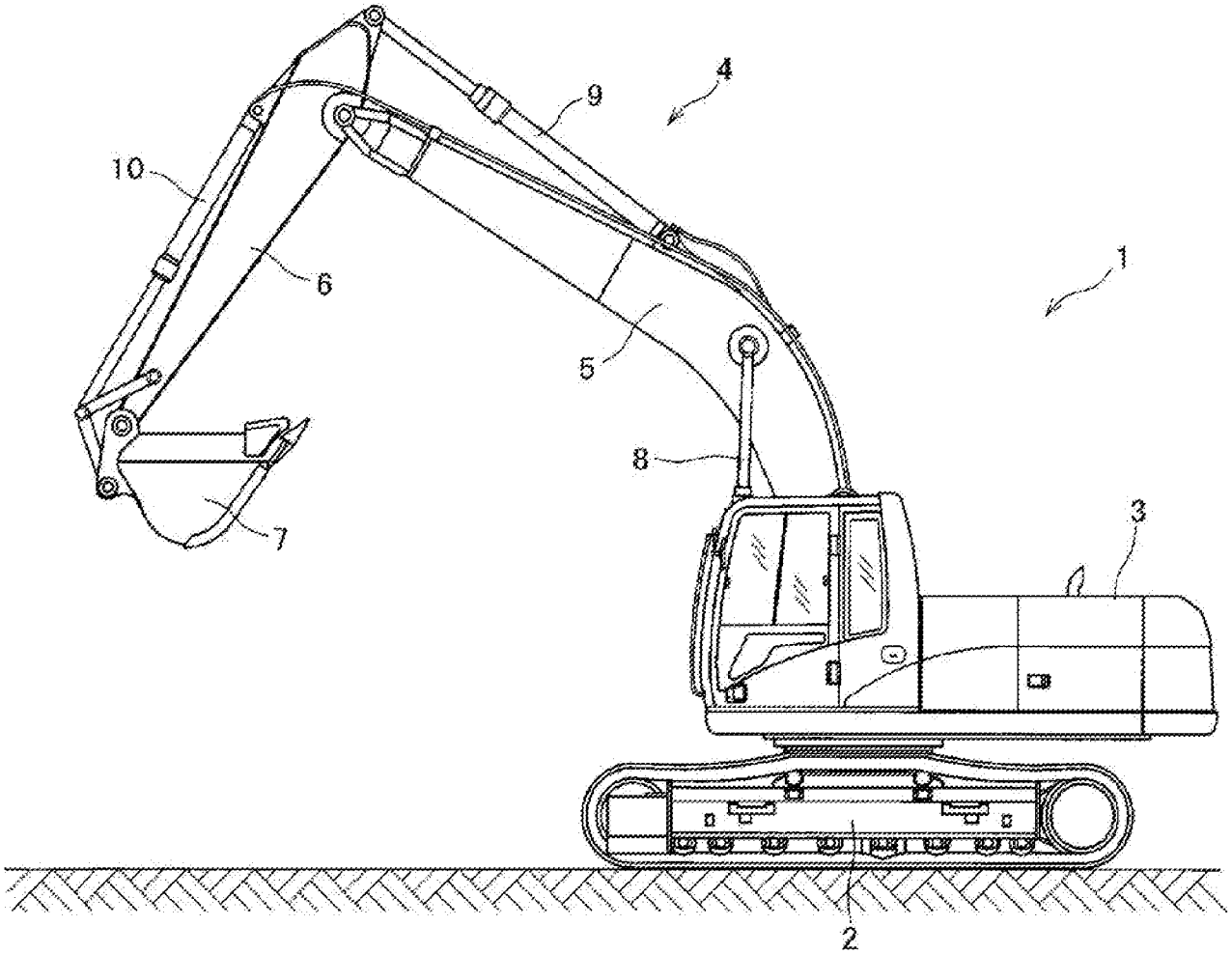
FIG. 1 is a side view of a hydraulic excavator.

First of all, an explanation about first embodiment of the present invention is provided based on FIGS. 1 to 6; FIG. 1 is a drawing illustrating hydraulic excavator 1 as an example of construction machine according to this invention, wherein the hydraulic excavator 1 is composed of a crawler type lower traveling body 2, an upper swiveling body 3 swivelably supported on the lower traveling body 2, a front working machine 4 mounted on the upper swiveling body 3, and others; and furthermore, the front working machine 4 is composed of a boom 5 whose base end part is supported vertically swingably by upper swiveling body 3, a stick 6 longitudinally swingably supported at an end part of the boom 5, a bucket 7 swivelably mounted at an end part of the stick 6, and others; wherein the hydraulic excavator 1 is provided with various hydraulic actuators, such as a boom cylinder 8, stick cylinder 9, and bucket cylinder 10 for swinging the boom 5, stick 6, and bucket 7 respectively; left and right traveling motors (not shown) for moving the lower traveling body 2; a swiveling motor (not shown) for swiveling the upper swiveling body 3. Note that the constitution of hydraulic excavator 1 is similar to those according to second and third embodiments mentioned later and FIG. 1 is common to first to third embodiments. Also, in description below, a swing of stick 6 bringing the end part of stick close to the body is assumed to be stick-in (in-side swing) and the swing of stick 6 moving the end part of stick away from the body is assumed to be stick-out (out-side swing).

When oil is supplied into head side oil chamber 8*a* and discharged from rod side oil chamber 8*b*, the boom cylinder 8 is configured to extend and the boom 5 is configured to rise; meanwhile, when the oil is supplied into the rod side oil chamber 8*b* and discharged from the head side oil chamber 8*a*, the boom 5 is configured to lower. When the oil is supplied into the head side oil chamber 9*a* and discharged from the rod side oil chamber 9*b*, the stick cylinder 9 is configured to extend and the stick 6 is configured to swing toward in-side; meanwhile, when oil is supplied into the rod side oil chamber 9*b* and discharged from the head side oil chamber 9*a*, the stick cylinder 9 is configured to contract and the stick 6 is configured to swing toward out-side; now based on FIG. 2, an explanation is provided about oil feed/discharge control for these boom cylinder 8 and stick cylinder 9; in FIG. 2, reference numbers 11, 12 denote first and second hydraulic pumps as hydraulic supply source for various hydraulic actuators installed on the hydraulic excavator 1 mentioned above, reference numbers 13, 14 denote first and second oil passages through which delivery oil is supplied from first and second hydraulic pumps 11, 12, reference number 15 denotes an oil tank, reference numbers 16, 17 denote first and second boom spool valves for controlling oil supply and discharge for the boom cylinder 8, reference numbers 18, 19 denote first and second stick spool valves for controlling oil supply and discharge for the stick cylinder 9; the first boom spool valve 16 and first stick spool valve 18 are connected to the first pump oil passage 13, and the second boom spool valve 17 and second stick spool valve 19 are connected to the second pump oil passage 14 respectively. Furthermore, at an upstream side of the first stick spool valve 18, a poppet valve 20 mentioned later is disposed, which controls the supply flow rate from first hydraulic pump 11 to first stick spool valve 18.

In addition, since the boom cylinder 8 and stick cylinder 9 are hydraulic actuator which requires large flow rate, the first and second boom spool valves 16, 17 and the first and second stick spool valves 18, 19 are installed so that pressure oil can be supplied from both the first and second hydraulic pumps 11, 12. Also, in the FIG. 2, reference numbers 21, 22 denote a left travel spool valve and bucket spool valve both connected to first pump oil passage 13, reference numbers 23, 24 denote a right travel spool valve and rotation spool valve both connected to second pump oil passage 14, wherein these spool valves 21 to 24 change over between neutral and operation position according to operations of corresponding manipulator to control oil supply and discharge for corresponding hydraulic actuator (left travel motor, bucket cylinder 10, right travel motor, and rotation motor); but detailed description about these spool valves 21 to 24 is omitted.

Figure 2:
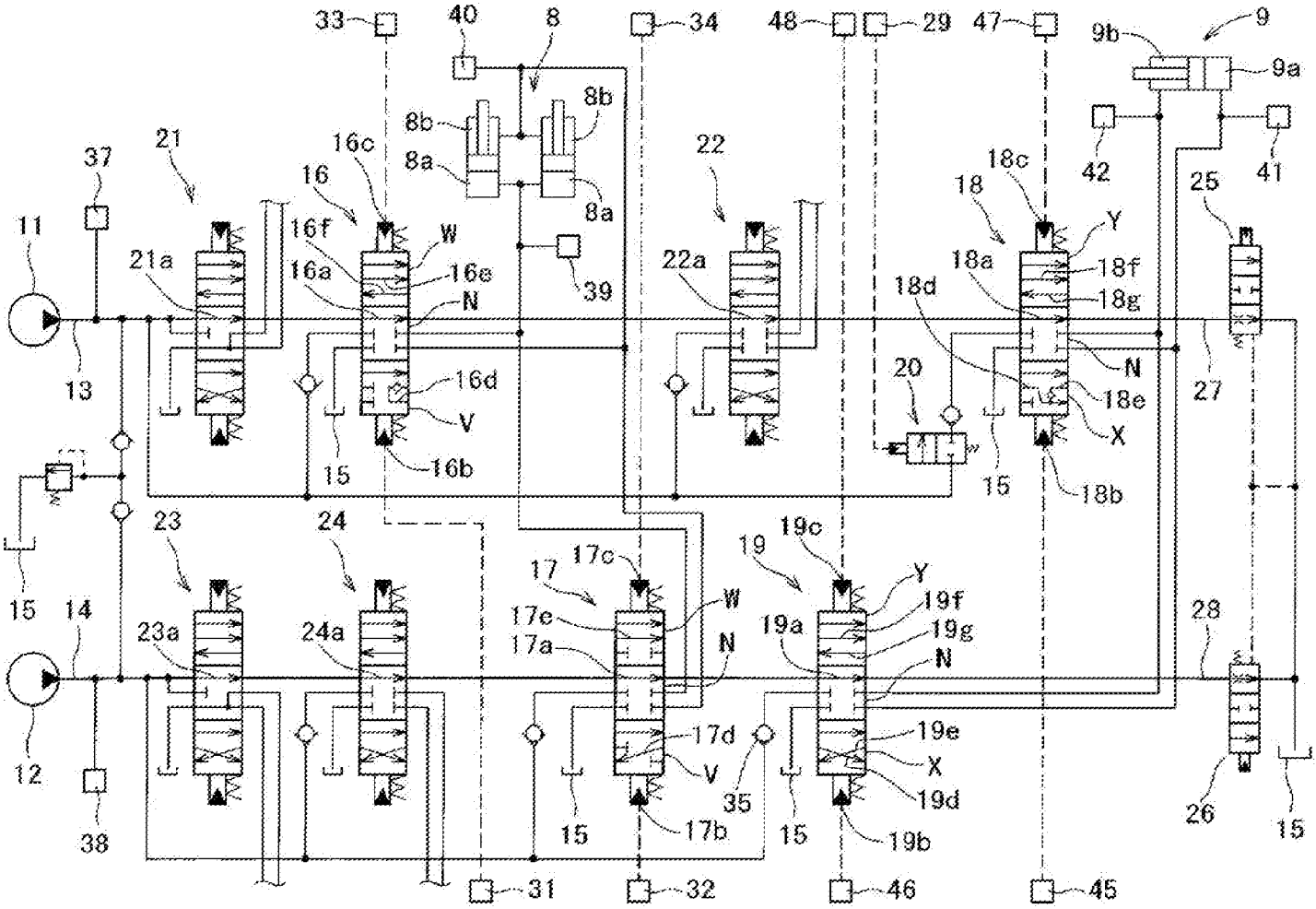
FIG. 2 is a hydraulic control circuit illustrating a first embodiment.
Figure 3A:
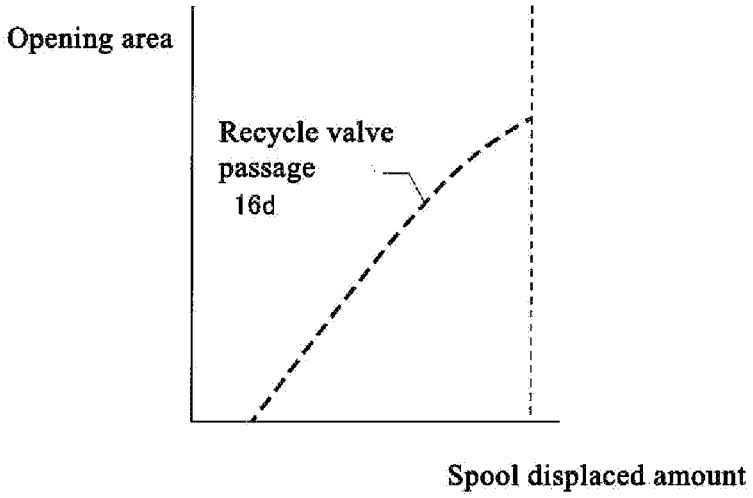
FIG. 3A illustrates the opening characteristics of first boom spool valve at lowering side operation position.
Figure 3B:
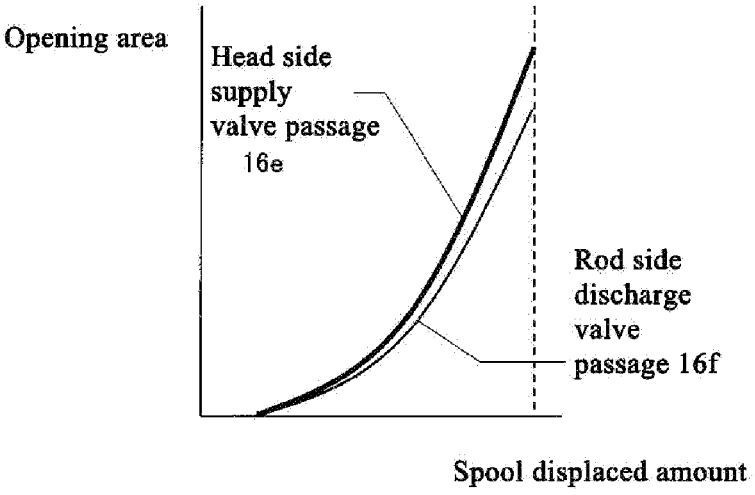
FIG. 3B illustrates the opening characteristics of first boom spool valve at raising side operation position.
Figure 3C:
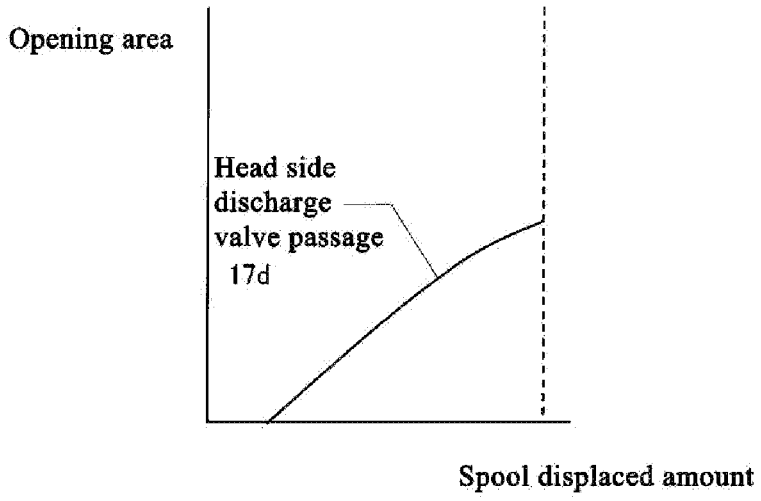
FIG. 3C illustrates the opening characteristics of second boom spool valve at lowering side operation position.
Figure 3D:
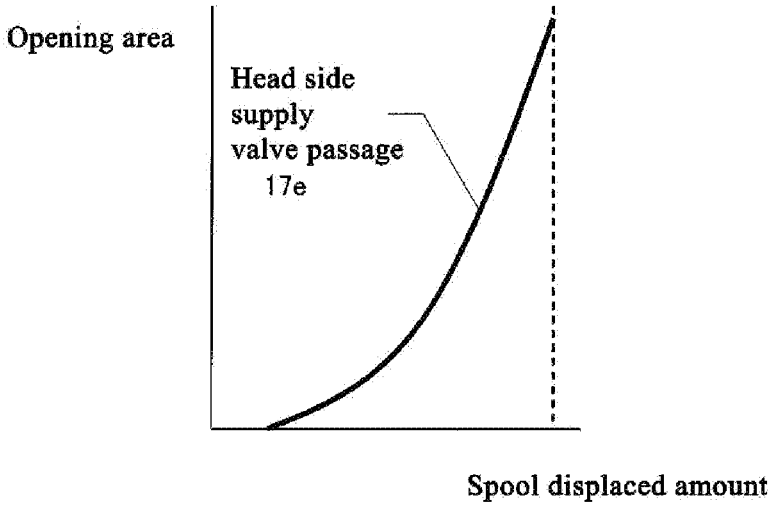
FIG. 3D illustrates the opening characteristics of second boom spool valve at raising side operation position.
Figure 4A:
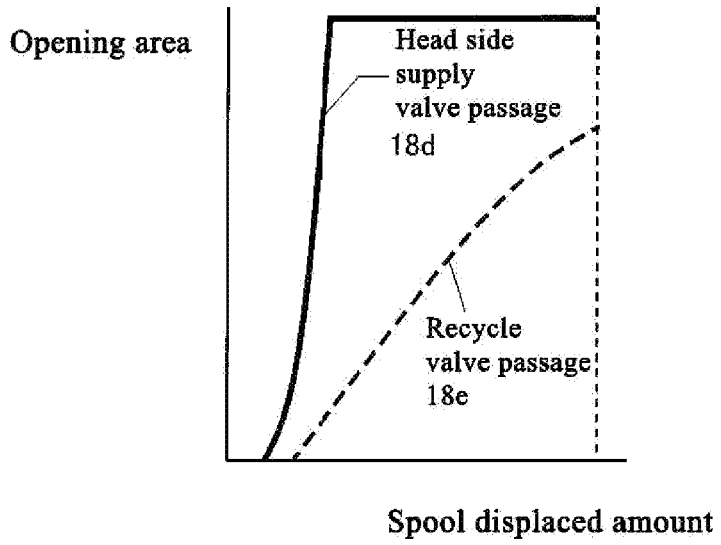
FIG. 4A illustrates the opening characteristics of first stick spool valve at in-side operation position.
Figure 4B:
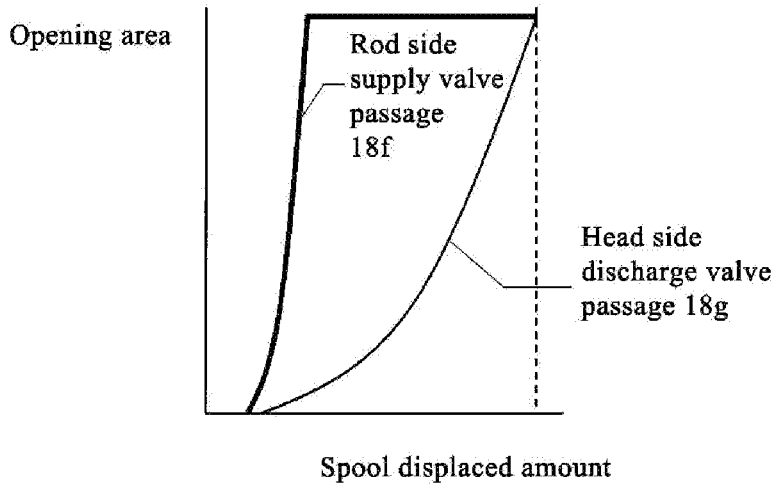
FIG. 4B illustrates the opening characteristics of first stick spool valve at out-side operation position.
Figure 4C:
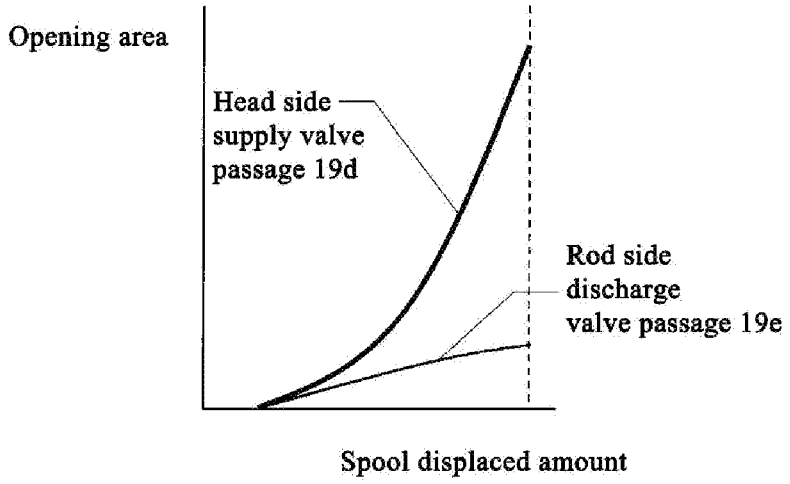
FIG. 4C illustrates the opening characteristics of second stick spool valve at in-side operation position.
Figure 4D:
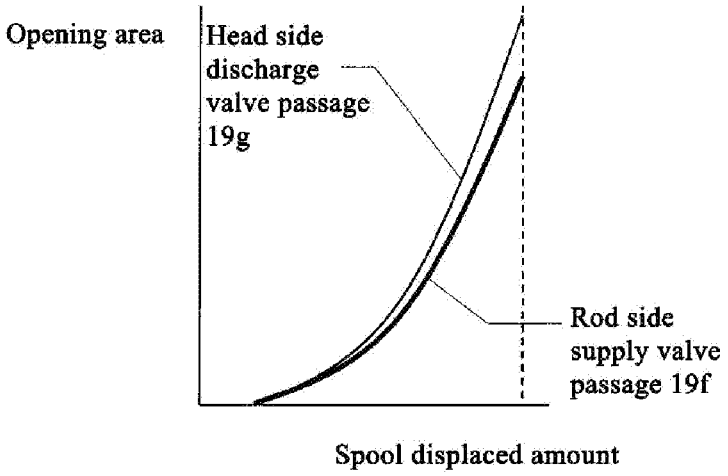
FIG. 4D illustrates the opening characteristics of second stick spool valve at out-side operation position.

Also in FIG. 2, reference numbers 25, 26 denote first and second bypass valves; the first bypass valve 25 controls a flow rate of first center bypass oil passage 27 passing through center bypass passages 21*a*, 16*a*, 22*a*, and 18*a* in order, which are formed by spool valves 21, 16, 22, and 18 and connected to first pump oil passage 13, and leading to first hydraulic pump 11 and oil tank 15, and the second bypass valve 26 controls a flow rate of second center bypass oil passage 28 passing through center bypass passages 23*a*, 24*a*, 17*a*, and 19*a* in order, which are formed by spool valves 23, 24, 17, and 19 and connected to second pump oil passage 14, and leading to second hydraulic pump 12 and the oil tank 15. In this case, the center bypass passages 21*a*, 16*a*, 22*a*, 18*a*, 23*a*, 24*a*, 17*a*, and 19*a* formed by the spool valves 21, 16, 22, 18, 23, 24, 17, and 19 have roughly a certain opening area regardless of change-over position or spool's displaced amount of spool valves 21, 16, 22, 18, 23, 24, 17, and 19, and in addition, the first and second bypass valves 25, 26 are configured to control increase or decrease of the flow rate of first and second center bypass oil passages 27, 28, i.e. bypass flow rate feeding from first and second hydraulic pumps 11, 12, to oil tank 15, by controlling increase or decrease of opening area based on control signal output by control unit 30 mentioned later to first and second bypass valve solenoid valves 49, 50. As the bypass flow rate is controlled to be increased or decreased by the first and second bypass valves 25, 26, the delivery flow rate from first and second hydraulic pumps 11, 12 is controlled to be increased or decreased, and thus, the delivery flow rate from first and second hydraulic pumps 11, 12 can be supplied to spool valves 21, 16, 22, 18, 23, 24, 17, and 19 in just proportion.

In addition, according to this embodiment, as first and second bypass oil passages of this invention, first and second center bypass oil passages are provided passing through each spool's center bypass passage, at its lowermost stream, first and second bypass valves are disposed, but at uppermost stream of these spools, first and second bypass oil passages can be provided for feeding the oil from first and second hydraulic pumps to the oil tank and first and second bypass valves can be disposed in the first and second bypass oil passages. In this case, center bypass passage formed on each spool valve can be abolished.

Next, an explanation is provided in detail about oil supply and discharge control for the boom cylinder 8.

First of all, the first boom spool valve 16 is a three position change-over valve having pilot ports 16*b*, 16*c* at lowering (contracted) and raising (extended) sides, wherein, when a pilot pressure is not input into both pilot ports 16*b*, 16*c*, the valve is positioned at neutral position N, where pressure oil is not supplied to nor discharged from the boom cylinder 8, but when the pilot pressure is input into the lowering side pilot port 16*b*, the valve switches to a lowering side operation position V to open a recycle valve passage 16*d* for supplying the discharge oil from head side oil chamber 8*a* of boom cylinder 8 to rod side oil chamber 8*b*. Also, the first boom spool valve 16 is configured, when the pilot pressure is input into raising side pilot port 16*c*, to switch to raising side operation position W and open head side supply valve passage 16*e* for supplying the delivery oil from first hydraulic pump 11 to head side oil chamber 8*a* of boom cylinder 8 and open rod side discharge valve passage 16*f* for feeding the discharge oil from the rod side oil chamber 8*b* of boom cylinder 8 to the oil tank 15. Note that, in the recycle valve passage 16*d*, a check valve to block an oil flow from rod side oil chamber 8*b* to head side oil chamber 8*a*.

Also, the second boom spool valve 17 is the three position change-over valve having pilot ports 17*b*, 17*c* at lowering (contracted) and raising (extended) sides, wherein, when the pilot pressure is not input into both pilot ports 17*b*, 17*c*, the valve 17 is positioned at neutral position N, where the pressure oil is not supplied to nor discharged from the boom cylinder 8, but when the pilot pressure is input into the lowering side pilot port 17*b*, the valve 17 switches to the lowering side operation position V to open a head side discharge valve passage 17*d* for feeding the discharge oil from head side oil chamber 8*a* of boom cylinder 8 to oil tank 15. Also, the second boom spool valve 17 is configured, when the pilot pressure is input into raising side pilot port 17*c*, to switch to the raising side operation position W and open the head side supply valve passage 17*e* for supplying the delivery oil from second hydraulic pump 12 to head side oil chamber 8*a* of boom cylinder 8.

Furthermore, in the FIG. 2, reference numbers 31, 32 denote first and second lowering side solenoid valves for outputting the pilot pressures to the lowering side pilot ports 16*b*, 17*b* for the first and second boom spool valves 16, 17, reference numbers 33, 34 denote first and second raising side solenoid valves for outputting the pilot pressure to raising side pilot ports 16*c*, 17*c*, wherein these first and second lowering and raising side solenoid valves 31 to 34 start to output the pilot pressure corresponding to the control signal based on the control signal from the control unit 30 mentioned later. Then, the spool of first and second boom spool valves 16, 17 is changed by the pilot pressure to be output from first and second lowering and raising side solenoid valves 31 to 34 to lowering and raising side pilot ports 16*b*, 17*b*, 16*c*, and 17*c* of first and second boom spool valves 16, 17, so that the valves 16, 17 switch to the lowering and raising side operation positions V, W; in this case, a spool's displaced amount is controlled to be increased or decreased according to increase or decrease of pilot pressure.

Here, FIG. 3 illustrates the opening characteristics of recycle valve passage 16*d* of the first boom spool valve 16 at lowering side operation position V, the head side supply valve passage 16*e* and rod side discharge valve passage 16*f* at raising side operation position W, and the head side discharge valve passage 17*d* of the second boom spool valve 17 at lowering side operation position V and head side supply valve passage 17*e* at raising side operation position W; as shown in the FIG. 3, the opening area of these valve passages 16*d*, 16*e*, 16*f*, 17*d*, and 17*e* is set to be large as the spool's displaced amount becomes large. As the opening area of valve passages 16*d*, 16*e*, 16*f*, 17*d*, and 17*e* increases or decreases in coordination with spool's displacement, the recycled flow rate from head side oil chamber 8*a* of boom cylinder 8 to rod side oil chamber 8*b*, the supply flow rate from first hydraulic pump 11 to head side oil chamber 8*a*, the discharge flow rate from rod side oil chamber 8*b* to oil tank 15, the discharge flow rate from head side oil chamber 8*a* to oil tank 15, and the supply flow rate from second hydraulic pump 12 to head side oil chamber 8*a* are controlled to be increased or decreased.

That is to say, when first and second boom spool valves 16, 17 are located at lowering side operation position V, the recycle valve passage 16*d* of first boom spool valve 16 controls the recycled flow rate from head side oil chamber 8*a* to rod side oil chamber 8*b* and the head side discharge valve passage 17*d* of second boom spool valve 17 controls the discharge flow rate from head side oil chamber 8*a* to oil tank 15. Meanwhile, when first and second boom spool valves 16, 17 are located at raising side operation position W, the head side supply valve passage 16*e* and rod side discharge valve passage 16*f* of first boom spool valve 16 control the supply flow rate from first hydraulic pump 11 to head side oil chamber 8*a* and the discharge flow rate from rod side oil chamber 8*b* to oil tank 15, and also, the head side supply valve passage 17*e* of second boom spool valve 17 controls the supply flow rate from second hydraulic pump 12 to head side oil chamber 8*a*.

Figure 5:
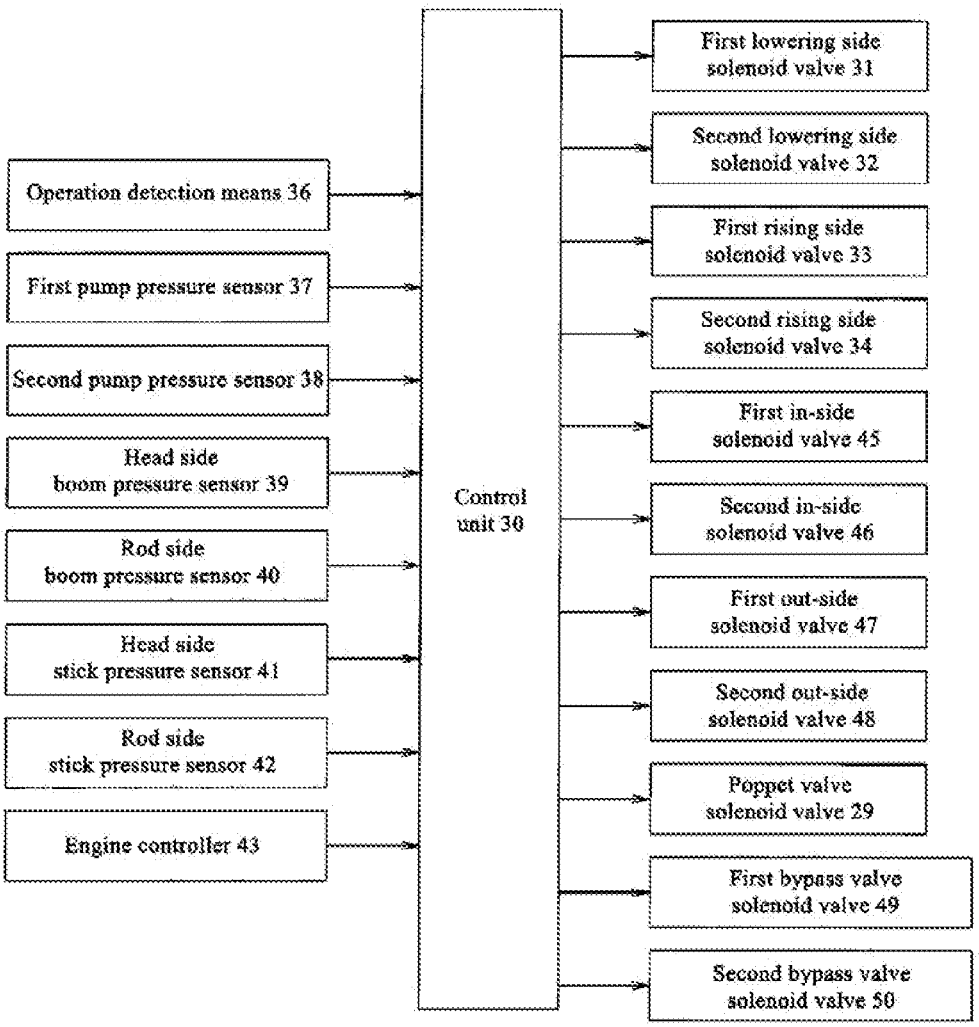
FIG. 5 is a block diagram illustrating input/output of control unit according to the first embodiment.

In contrast, as shown in FIG. 5, the control unit 30 is configured to be input signals from boom actuator, stick manipulator, operation detection means 36 for detecting each operation of various manipulators including manipulators for other hydraulic actuators installed on the hydraulic excavator 1 (according to this embodiment, the right/left traveling motors, bucket cylinder 10, swiveling motor), first and second pump pressure sensors 37, 38 for respectively detecting delivery pressure from first and second hydraulic pumps 11, 12, head side/rod side boom pressure sensors 39, 40 for respectively detecting pressure in head/rod side oil chambers 8*a*, 8*b* of boom cylinder 8, head side/rod side stick pressure sensors 41, 42 for detecting pressure in head/rod side oil chambers 9*a*, 9*b* of stick cylinder 9, various pressure detection sensors for other hydraulic actuators (not shown, but pressure sensors for respectively detecting pressure in head/rod side oil chambers of bucket cylinder 10, for example), engine controller 43, and others, and based on these input signals, output control signals to first and second lowering/rising side solenoid valves 31 to 34 for outputting pilot pressure to the first and second boom spool valves 16, 17, first and second in-side/out-side solenoid valves 45 to 48 mentioned later for outputting pilot pressure to first and second stick spool valves 18, 19, poppet valve solenoid valve 29 for outputting pilot pressure to poppet valve 20, various solenoid valves (not shown) for outputting pilot pressure to spool valves for other hydraulic actuators (in this embodiment, left travel spool valve 21, bucket spool valve 22, right travel spool valve 23, and swiveling spool valve 24), first bypass valve solenoid valve 49 for outputting pilot pressure to the first bypass valve 25, and second bypass valve solenoid valve 50 for outputting pilot pressure to second bypass valve 26.

Then, an explanation is provided about a control of first and second boom spool valves 16, 17 conducted by the control unit 30; when a signal of boom lowering operation is input from operation detection means 36, the control unit 30 outputs the control signal to first and second lowering side solenoid valves 31, 32. Thus, the pilot pressure is input into the lowering side pilot ports 16*b*, 17*b* of first and second boom spool valves 16, 17 to switch both first and second boom spool valves 16, 17 to lowering side operation position V. Then, as mentioned above, the first boom spool valve 16 at the lowering side operation position V controls the recycled flow rate from head side oil chamber 8*a* of boom cylinder 8 to rod side oil chamber 8*b* and the second boom spool valve 17 at the lowering side operation position V controls the discharge flow rate from head side oil chamber 8*a* to oil tank 15. Thus, the oil is discharged from head side oil chamber 8*a* and supplied into rod side oil chamber 8*b* to contract the boom cylinder 8 and lower the boom 5; here, based on the various signals (signal and others from the operation detection means 36 and various pressure sensors 37 to 42) input into the control unit 30, the control unit 30 calculates the recycle and discharge flow rates required to the boom cylinder 8 and outputs respective control signals to first and second lowering side solenoid valves 31, 32 in order to control them independently of each other. These independent controls of recycle and discharge flow rates are enabled since the first boom spool valve 16 controls only the recycled flow rate during lowering operation of boom 5 (contraction of boom cylinder 8) and the second boom spool valve 17 controls only the discharge flow rate.

Here, when the boom 5 is lowering, both first and second boom spool valves 16, 17 are configured not to supply the delivery oil from first and second hydraulic pumps 11, 12 to rod side oil chamber 8*b* of boom cylinder 8. That is because, during lowering operation of boom 5 (contraction of boom cylinder 8), a discharge amount from head side oil chamber 8*a* of boom cylinder 8 is remarkably large compared with a supply amount to rod side oil chamber 8*b* (about twice, for example) based on the relationship of piston's pressured area, in addition, the head side oil chamber 8*a* is highly pressured as whole weight of front working machine 4 is applied, and therefore, recycle oil from head side oil chamber 8*a* is enough for the oil supply to rod side oil chamber 8*b*. Then, during the lowering of boom 5, first and second hydraulic pumps 11, 12 can be configured not to supply the delivery oil to boom cylinder 8, contributing to energy saving.

Meanwhile, when a signal of boom raising operation is input from operation detection means 36, the control unit 30 outputs the control signal for outputting pilot pressure to first and second raising side solenoid valves 33, 34. Thus, the pilot pressure is input into raising side pilot ports 16*c*, 17*c* of first and second boom spool valves 16, 17 to switch both first and second boom spool valves 16, 17 to raising side operation position W. Then, as mentioned above, the first boom spool valve 16 at the raising side operation position W controls the supply flow rate from first hydraulic pump 11 to head side oil chamber 8*a* and the discharge flow rate from rod side oil chamber 8*b* to oil tank 15, and the second boom spool valve 17 at the raising side operation position W controls the supply flow rate from second hydraulic pump 12 to head side oil chamber 8*a*. Thus, the oil is supplied into head side oil chamber 8*a* and discharged from rod side oil chamber 8*b* to extend the boom cylinder 8 and raise the boom 5; here, based on the various signals (signal and others from operation detection means 36 and various pressure sensors 37 to 42, and engine controller 43) input into the control unit 30, the control unit 30 calculates the supply and discharge flow rates required to the boom cylinder 8 and outputs the control signal to each of first and second raising side solenoid valves 33, 34 in order to control them independently. These independent controls of supply and discharge flow rates are enabled since the first boom spool valve 16 controls the supply and discharge flow rates from first hydraulic pump 11 during raising operation of boom 5 (extension of boom cylinder 8) and the second boom spool valve 17 controls the supply flow rate from second hydraulic pump 12.

Note that, as for first boom spool valve 16 during raising of boom 5, the relationship between the opening areas of head side supply valve passage 16*e* and rod side discharge valve passage 16*f* is uniquely decided with a spool displaced amount; the supply/discharge flow rates for boom cylinder 8 can be controlled independently of each other by controlling the increase and decrease of opening area of head side supply valve passage 17*e*, which is connected to second boom spool valve 17 that controls the supply flow rate only, so that total supply flow rate from first and second boom spool valves (first and second hydraulic pumps 11, 12) 16, 17 will be the supply flow rate required by boom cylinder 8.

Next, an explanation is provided in detail about oil supply and discharge control for the stick cylinder 9.

First, the poppet valve 20 has a check function, is capable of metering, and is provided at an upstream side of first stick spool valve 18, i.e. at a supply oil passage from first hydraulic pump 11 to first stick spool valve 18. Also, the poppet valve 20 is started by pilot pressure output from the poppet valve solenoid valve 29 based on the control signal output by the control unit 30 to the poppet valve solenoid valve 29 to control the supply flow rate from first hydraulic pump 11 to first stick spool valve 18. The supply flow rate of first hydraulic pump 11 supplied from poppet valve 20 to first stick spool valve 18 is, as mentioned later, configured to be supplied as-is to stick cylinder 9 without being increased or decreased by the first stick spool valve 18.

Also, the first stick spool valve 18 is the three position change-over valve having in-side (extended side) and out-side (contracted side) pilot ports 18*b*, 18*c*; wherein, when the pilot pressure is not input into both pilot ports 18*b*, 18*c*, the valve 18 is positioned at neutral position N, where the pressure oil is not supplied to nor discharged from the stick cylinder 9, but when the pilot pressure is input into in-side pilot port 18*b*, the valve 18 switches to an in-side operation position X to open the head side supply valve passage 18*d* for supplying the delivery oil from first hydraulic pump 11 supplied through poppet valve 20 to head side oil chamber 9*a* of stick cylinder 9 and open recycle valve passage 18*e* for supplying the delivery oil from the rod side oil chamber 9*b* to head side oil chamber 9*a*. Also, the first stick spool valve 18 is configured, when the pilot pressure is input into out-side pilot port 18*c*, to switch to out-side operation position Y and open rod side supply valve passage 18*f* for supplying the delivery oil from first hydraulic pump 11 supplied through the poppet valve 20 to rod side oil chamber 9*b* and open head side discharge valve passage 18*g* for feeding delivery oil from head side oil chamber 9*a* to oil tank 15; as mentioned later, the head side supply valve passage 18*d* and rod side supply valve passage 18*f* are configured to supply the supply flow rate as-is from poppet valve 20 to stick cylinder 9 without increasing or decreasing the flow rate. Note that, in the recycle valve passage 18*e*, a check valve to block the oil flow from head side oil chamber 9*a* to rod side oil chamber 9*b*.

Also, the second stick spool valve 19 is the three position change-over valve having in-side (extended side) and out-side (contracted side) pilot ports 19*b*, 19*c*; wherein, when the pilot pressure is not input into both pilot ports 19*b*, 19*c*, the valve 19 is positioned at neutral position N, where the pressure oil is not supplied to nor discharged from stick cylinder 9, but when the pilot pressure is input into in-side pilot port 19*b*, the valve 19 switches to the in-side operation position X to open the head side supply valve passage 19*d* for supplying the delivery oil from second hydraulic pump 12 to head side oil chamber 9*a* of stick cylinder 9 and open rod side discharge valve passage 19*e* for feeding the delivery oil from rod side oil chamber 9*b* to oil tank 15. Also, the second stick spool valve 19 is configured, when the pilot pressure is input into out-side pilot port 19*c*, to switch to out-side operation position Y and open rod side supply valve passage 19*f* for supplying delivery oil from second hydraulic pump 12 to rod side oil chamber 9*b* and open head side discharge valve passage 19*g* for feeding the delivery oil from head side oil chamber 9*a* to oil tank 15.

Figure 6:
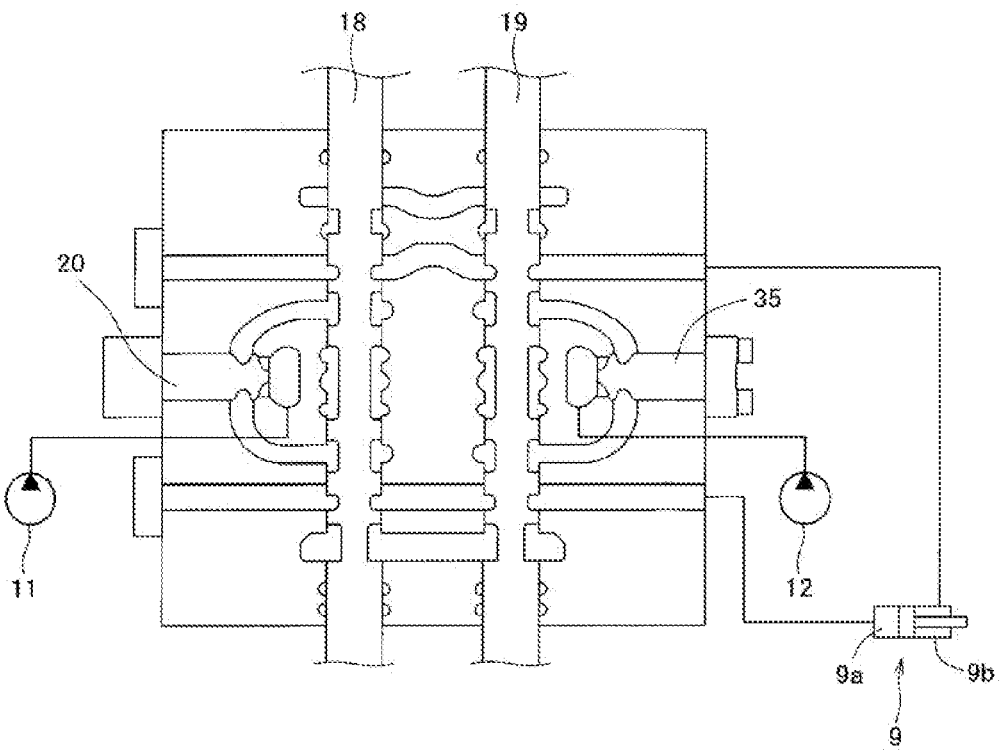
FIG. 6 is a drawing illustrating incorporated state of a poppet valve according to the first embodiment.

Here, as an allocation structure of poppet valve 20 is shown in FIG. 6, the poppet valve 20 is, in a valve block where first and second stick spool valves 18, 19 are incorporated, incorporated in a pump port connected to first hydraulic pump 11 for supplying the delivery oil from first hydraulic pump 11 to first stick spool valve 18. Also, in FIG. 6, a reference number 35 denotes the check valve incorporated in the pump port connected to second hydraulic pump 12 for supplying the delivery oil from second hydraulic pump 12 to second stick spool valve 19; wherein the check valve 35 is configured to block a backflow from second stick spool valve 19 to second hydraulic pump 12. That is to say, in the pump port in the valve block where spool valves such as first and second stick spool valves 18, 19 are incorporated, in general, the check valve such as the check valve 35 mentioned above is incorporated to block the backflow from spool valve to hydraulic pump; according to this embodiment, in place of this check valve, a poppet valve 20 having a check function and being capable of metering is configured to be incorporated in the pump port; thus, there is no need to ensure a space for the poppet valve 20 separately and it is easy to dispose the poppet valve 20 there.

Furthermore, in the FIG. 2, reference numbers 45, 46 denote first and second in-side solenoid valves for outputting pilot pressures to the in-side pilot ports 18*b*, 19*b* of first and second stick spool valves 18, 19, reference numbers 47, 48 denote first and second out-side solenoid valves for outputting pilot pressure to out-side pilot ports 18*c*, 19*c*; wherein these first and second in-side/out-side solenoid valves 45 to 48 start to output pilot pressure corresponding to the control signal based on the control signal from the control unit 30. Then, the pilot pressure output from first and second in-side/out-side solenoid valves 45 to 48 to the in-side and out-side pilot ports 18*b*, 19*b*, 18*c*, 19*c* of first and second stick spool valves 18, 19 displace each spool of first and second stick spool valves 18, 19, so that the valves 18, 19 switch to in-side and out-side operation positions X, Y; in this case, each spool's displaced amount is controlled to be increased or decreased according to a change of pilot pressure.

Here, FIG. 4 illustrates the opening characteristics of head side supply valve passage 18*d* and recycle valve passage 18*e* at in-side operation position X of the first stick spool valve 18, rod side supply valve passage 18*f* and head side discharge valve passage 18*g* at out-side operation position Y, head side supply valve passage 19*d* and rod side discharge valve passage 19*e* at in-side operation position X of second stick spool valve 19, and rod side supply valve passage 19*f* and head side discharge valve passage 19*g* at out-side operation position Y; as shown in the FIG. 4, in the head side and rod side supply valve passages 18*d*, 18*f* and rod side supply valve passage 18*f* of the first stick spool valve 18, the opening area is set to become maximum just when the spool displaces from the neutral position N, i.e. even when the spool's displaced amount is small. Thus, the first stick spool valve 18 is configured to supply the supply flow rate as-is from first hydraulic pump 11 supplied through poppet valve 20 to the head side and rod side oil chambers 9*a*, 9*b* of stick cylinder 9 without increasing or decreasing the flow rate. That is, the supply flow rate from the first hydraulic pump 11 to the stick cylinder 9 is not controlled at first stick spool valve 18, and the supply flow rate controlled at the poppet valve 20 is supplied as-is to the stick cylinder 9.

Meanwhile, the opening area of recycle valve passage 18*e* of first stick spool valve 18 and head side discharge valve passage 18*g*, head side supply valve passage 19*d* of second stick spool valve 19, rod side discharge valve passage 19*e*, rod side supply valve passage 19*f*, and head side discharge valve passage 19*g* is configured to become larger as the spool's displaced amount gets large. As the opening area of valve passages 18*e*, 18*g*, 19*d*, 19*e*, 19*f*, and 19*g* increases or decreases in coordination with the spool's displacement, the recycled flow rate from rod side oil chamber 9*b* of stick cylinder 9 to head side oil chamber 9*a*, the discharge flow rate from head side oil chamber 9*a* to oil tank 15, the supply flow rate from second hydraulic pump 12 to head side oil chamber 9*a*, the discharge flow rate from rod side oil chamber 9*b* to oil tank 15, the supply flow rate from second hydraulic pump 12 to rod side oil chamber 9*b*, and the discharge flow rate from head side oil chamber 9*a* to oil tank 15 are controlled to be increased or decreased.

That is to say, when first and second stick spool valves 18, 19 are positioned at in-side operation position X, the supply flow rate from first hydraulic pump 11 to head side oil chamber 9*a* is controlled with the poppet valve 20, the recycled flow rate from rod side oil chamber 9*b* to head side oil chamber 9*a* is controlled with recycle valve passage 18*e* of first stick spool valve 18, and the supply flow rate from second hydraulic pump 12 to head side oil chamber 9*a* and the discharge flow rate from rod side oil chamber 9*b* to oil tank 15 are controlled with head side supply valve passage 19*d* and rod side discharge valve passage 19*e* of second stick spool valve 19. Meanwhile, when first and second stick spool valves 18, 19 are positioned at out-side operation position Y, the supply flow rate from first hydraulic pump 11 to rod side oil chamber 9*b* is controlled with poppet valve 20, the discharge flow rate from head side oil chamber 9*a* to oil tank 15 is controlled with head side discharge valve passage 18*g* of first stick spool valve 18, and the supply flow rate from second hydraulic pump 12 to rod side oil chamber 9*b* and the discharge flow rate from head side oil chamber 9*a* to oil tank 15 are controlled with rod side supply valve passage 19*f* of second stick spool valve 19 and head side discharge valve passage 19*g*.

Thereafter, an explanation is provided about a control of poppet 20 and first and second stick spool valves 18, 19 conducted by the control unit 30; when a stick-in signal is input from operation detection means 36, the control unit 30 outputs the control signal to poppet valve solenoid valve 29 for outputting pilot pressure. Thus, the poppet valve 20 starts to supply the delivery oil from first hydraulic pump 11 to first stick spool valve 18 while the flow rate of delivery oil is controlled. Furthermore, the control unit 30 outputs the control signal to first and second in-side solenoid valves 45, 46 for outputting pilot pressure. Thus, the pilot pressure is input into in-side pilot ports 18*b*, 19*b* of first and second stick spool valves 18, 19 to switch both first and second stick spool valves 18, 19 to in-side operation position X. Then, as mentioned above, the poppet valve 20 controls the supply flow rate from first hydraulic pump 11 to head side oil chamber 9*a*, the first stick spool valve 18 at in-side operation position X controls the recycled flow rate from rod side oil chamber 9*b* to head side oil chamber 9*a*, and the second stick spool valve 19 at in-side operation position X controls the supply flow rate from second hydraulic pump 12 to head side oil chamber 9*a* and the discharge flow rate from rod side oil chamber 9*b* to oil tank 15. Thus, the oil is supplied into head side oil chamber 9*a* and discharged from rod side oil chamber 9*b* to extend the stick cylinder 9 and swing the stick 6 to in-side; here, based on the various signals (signal and others from the operation detection means 36, various pressure sensors 37 to 42, and engine controller 43) input into the control unit 30, the control unit 30 calculates the supply, recycle, and discharge flow rates required to stick cylinder 9 and outputs respective control signals to poppet valve solenoid valve 29 and first and second in-side solenoid valves 45, 46 in order to control them independently of each other. These independent controls of supply, recycle, and discharge flow rates are enabled since, during in-side operation of stick 6 (extension of stick cylinder 9), the poppet valve 20 controls the supply flow rate from first hydraulic pump 11, the first stick spool valve 18 controls the recycled flow rate, and the second stick spool valve 19 controls the supply and discharge flow rates from second hydraulic pump 12.

Note that, during the in-side operation of stick 6, the relationship between opening areas of head side supply valve passage 19*d* and rod side discharge valve passage 19*e* of second stick spool valve 19 is uniquely decided with the spool displaced amount; the supply/discharge flow rates for the stick cylinder 9 can be controlled independently of each other by controlling the increase and decrease of opening area of poppet valve 20, which controls only the supply flow rate, so that total supply flow rate from the poppet valve 20 (supply flow rate from first hydraulic pump 11) and second stick spool valve 19 (supply flow rate from second hydraulic pump 12) is controlled to be the supply flow rate required by stick cylinder 9.

Meanwhile, when a stick-out operation signal is input from operation detection means 36, the control unit 30 outputs the control signal to poppet valve solenoid valve 29 for outputting pilot pressure. Thus, the poppet valve 20 starts to supply the delivery oil from first hydraulic pump 11 to first stick spool valve 18 while the flow rate of delivery oil is controlled. Furthermore, the control unit 30 outputs the control signal to first and second out-side solenoid valves 47, 48 for outputting the pilot pressure. Thus, the pilot pressure is input into out-side pilot ports 18*c*, 19*c* of first and second stick spool valves 18, 19 to switch both first and second stick spool valves 18, 19 to out-side operation position Y. Then, as mentioned above, the poppet valve 20 controls the supply flow rate from first hydraulic pump 11 to rod side oil chamber 9*b*, the first stick spool valve 18 at out-side operation position Y controls the discharge flow rate from head side oil chamber 9*a* to oil tank 15, and the second stick spool valve 19 at out-side operation position Y controls the supply flow rate from second hydraulic pump 12 to rod side oil chamber 9*b* and the discharge flow rate from head side oil chamber 9*a* to oil tank 15. Thus, the oil is supplied into rod side oil chamber 9*b* and discharged from head side oil chamber 9*a* to contract stick cylinder 9 and swing stick 6 to out-side; here, based on the various signals (signal and others from the operation detection means 36, various pressure sensors 37 to 42, and engine controller 43) input into the control unit 30, the control unit 30 calculates the supply and discharge flow rates required to stick cylinder 9 and outputs respective control signals to poppet valve solenoid valve 29 and first and second out-side solenoid valves 47, 48 in order to control them independently of each other. These independent controls of supply and discharge flow rates are enabled since, during out-side operation of stick 6 (contraction of stick cylinder 9), the poppet valve 20 controls the supply flow rate from first hydraulic pump 11, the first stick spool valve 18 controls the discharge flow rate, and the second stick spool valve 19 controls the supply and discharge flow rates from second hydraulic pump 12.

Note that, during the out-side operation of stick 6, the relationship between opening areas of rod side supply valve passage 19*f* and head side discharge valve passage 19*g* of second stick spool valve 19 is uniquely decided with the spool displaced amount; the supply/discharge flow rates for stick cylinder 9 can be controlled independently of each other by controlling the increase and decrease of opening area of poppet valve 20, which controls only the supply flow rate, so that total supply flow rate from poppet valve 20 (supply flow rate from first hydraulic pump 11) and second stick spool valve 19 (supply flow rate from second hydraulic pump 12) is controlled to be the supply flow rate required by stick cylinder 9 or by controlling the increase and decrease of opening area of head side discharge valve passage 18*g* of first stick spool valve 18, which controls only the discharge flow rate, so that total discharge flow rate from first stick spool valve 18 and second stick spool valve 19 is controlled to be the discharge flow rate required to stick cylinder 9.

As described above, according to the first embodiment, in hydraulic control circuit of hydraulic excavator 1, there are provided first and second hydraulic pumps 11, 12 as a hydraulic supply source, first and second spool valves 18, 19 being connected respectively to the first and second hydraulic pumps 11, 12 and controlling hydraulic supply and discharge for the stick cylinder 9, and further, a poppet valve 20 controlling supply flow rate from first hydraulic pump 11 to first stick spool valve 18 at upstream side of the first stick spool valve 18, wherein the first stick spool valve 18 supplies hydraulic oil from the poppet valve 20 to the stick cylinder 9 as-is without changing its flow rate. Then, when the stick cylinder 9 is extended (stick-in operation), the poppet valve 20 controls the supply flow rate from first hydraulic pump 11 to head side oil chamber 9*a* of stick cylinder 9, the first stick spool valve 18 controls the recycled flow rate from rod side oil chamber 9*b* of stick cylinder 9 to head side oil chamber 9*a*, and the second stick spool valve 19 controls supply flow rate from second hydraulic pump 12 to head side oil chamber 9*a* of stick cylinder 9 and discharge flow rate from rod side oil chamber 9*b* to oil tank 15.

That is to say, during the extension of stick cylinder 9, the poppet valve 20 controls only the supply flow rate from first hydraulic pump 11 to head side oil chamber 9*a*, so the poppet valve 20 can control supply flow rate from first hydraulic pump 11 independently. Also, the first stick spool valve 18 controls only recycled flow rate from rod side oil chamber 9*b* to head side oil chamber 9*a*, so the first stick spool valve 18 can control the recycled flow rate independently. Also, the second stick spool valve 19 controls supply flow rate from second hydraulic pump 12 to head side oil chamber 9*a* and discharge flow rate from rod side oil chamber 9*b* to oil tank 15; in this case, the second stick spool valve 19 can control discharge flow rate independently by giving precedence to the discharge flow rate control. Furthermore, the second stick spool valve 19 cannot control supply flow rate independently, but the poppet valve 20 controls to increase or decrease supply flow rate from first hydraulic pump 11, so that total flow rate from both first and second hydraulic pumps 11, 12 can be controlled independently.

As the result, during the extension of stick cylinder 9, the supply, discharge, and recycle flow rates for the stick cylinder 9 can be controlled independently of each other, and according to various work contents of stand-alone work for driving the stick cylinder 9 alone, compound work for driving other hydraulic actuator (boom cylinder 8, bucket cylinder 10, for example) as well, light load work, heavy load work, and others, the relationship among the supply, discharge, and further recycle flow rates can be changed, contributing high efficiency and improvement of operability. Furthermore, this control is done simply by making use of first and second stick spool valves 18, 19, which are generally used in hydraulic control circuit of hydraulic excavator 1 conventionally, and by providing poppet valve 20 at upstream side of first stick spool valve 18 for controlling supply flow rate, so the control can be easily produced by using a valve unit for conventional circuit configuration, attaining cost reduction.

Furthermore in this regard, during the contraction of the stick cylinder 9 (stick-out operation), the poppet valve 20 controls supply flow rate from first hydraulic pump 11 to rod side oil chamber 9*b* of the stick cylinder 9, the first stick spool valve 18 controls discharge flow rate from head side oil chamber 9*a* of the stick cylinder 9 to oil tank 15, and the second stick spool valve 19 controls supply flow rate from second hydraulic pump 12 to rod side oil chamber 9*b* of the stick cylinder 9 and discharge flow rate from head side oil chamber 9*a* to oil tank 15.

That is to say, during the contraction of stick cylinder 9, the poppet valve 20 controls only the supply flow rate from first hydraulic pump 11 to rod side oil chamber 9*b*, so the poppet valve 20 can control supply flow rate from first hydraulic pump 11 independently. Also, the first stick spool valve 18 controls only the discharge flow rate from head side oil chamber 9*a* to oil tank 15, so the first stick spool valve 18 can control the discharge flow rate independently. Also, the second stick spool valve 19 controls supply flow rate from second hydraulic pump 12 to rod side oil chamber 9*b* and discharge flow rate from head side oil chamber 9*a* to oil tank 15; in this case, the second stick spool valve 19 can control either supply or discharge flow rate independently by giving precedence to either supply or discharge flow rate control. Furthermore, the second stick spool valve 19 cannot control the other (discharge or supply) flow rate independently, but when the other flow rate is discharge flow rate, total discharge flow rate from stick cylinder 9 can be controlled independently by controlling increase and decrease of discharge flow rate from first stick spool valve 18, and also, when the other flow rate is supply flow rate, total supply flow rate from both first and second hydraulic pumps 11, 12 to the stick cylinder 9 can be controlled independently of each other by controlling increase and decrease of supply flow rate from first hydraulic pumps 11 with poppet valve 20. As the result, even when the stick cylinder 9 is contracted, the supply and discharge flow rates for the stick cylinder 9 can also be controlled independently of each other, contributing high efficiency and improvement of operability largely.

Furthermore in this regard, the hydraulic control circuit of hydraulic excavator 1 comprises the first and second bypass valves 25, 26 that control the flow rate of first and second bypass oil passages 27, 28 respectively for feeding the delivery oil from first and second hydraulic pumps 11, 12 to oil tank 15. Thus, the first and second bypass valves 25, 26 can control the flow rate from first and second hydraulic pumps 11, 12 to oil tank 15 so that the delivery flow rate from first and second hydraulic pumps 11, 12 can be controlled accurately.

In addition, according to this embodiment, the boom cylinder 8 as well as stick cylinder 9 is configured to be able to control the supply, discharge, and recycled flow rates independently of each other by making use of first and boom stick spool valves 16, 17, thus both the stick cylinder 9 and boom cylinder 8, which are installed in the hydraulic excavator 1 and are hydraulic actuator needing large flow rates, can control the supply, discharge, and recycled flow rates independently of each other by utilizing first and second spool valves (first and second stick spool valves 18, 19 and first and second boom spool valves 16, 17), contributing high efficiency of whole hydraulic excavator 1, improvement of operability, and cost suppression.

Figure 7:
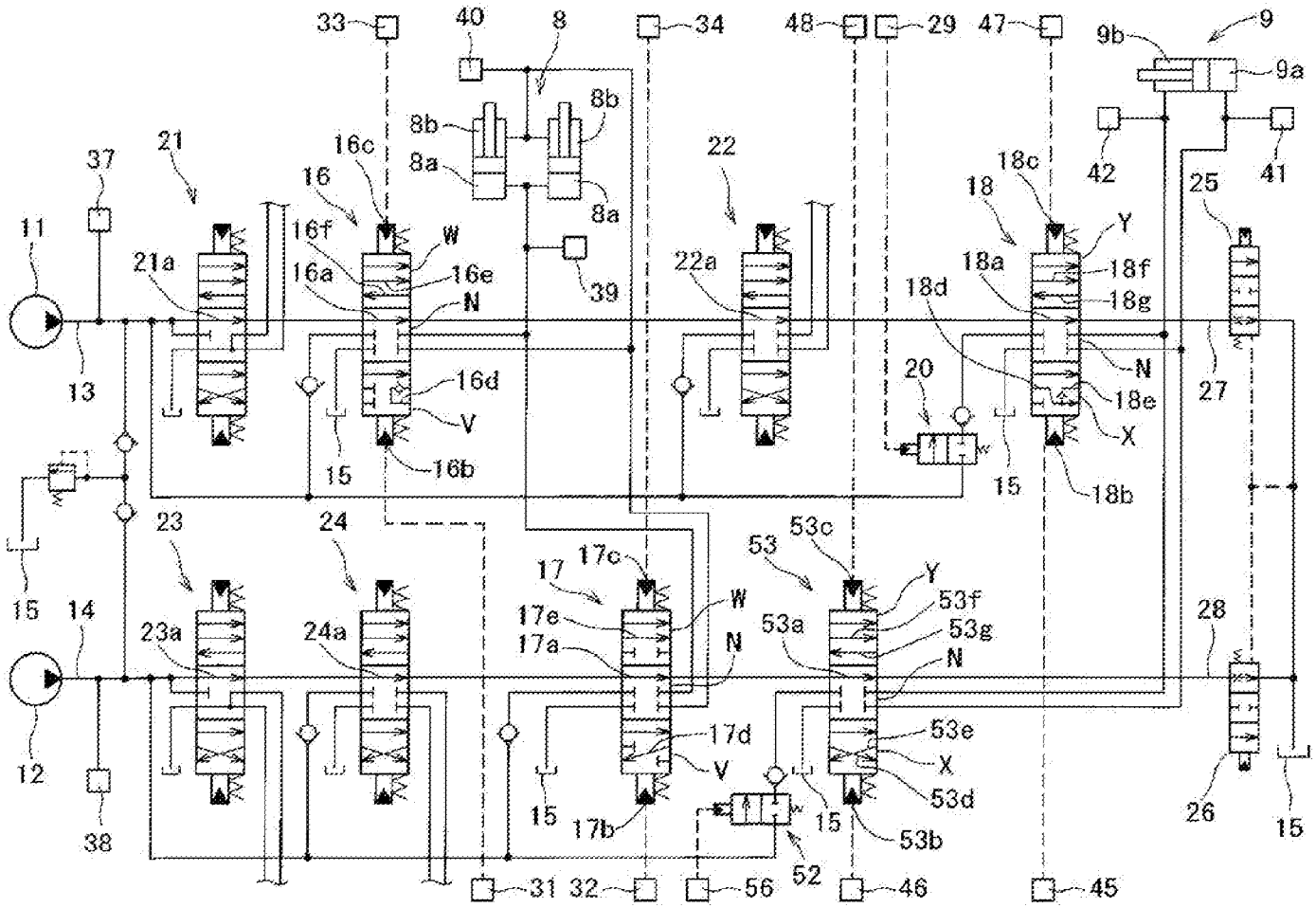
FIG. 7 is a hydraulic control circuit illustrating a second embodiment.

Next, second embodiment of the present invention is described in reference to hydraulic control circuit diagram shown in FIG. 7; since anything other than second poppet valve 52, second poppet valve solenoid valve 56, and second stick spool valve 53 mentioned later is the same as first embodiment, same number is appended to them and an explanation is omitted about it. Note that first poppet valve 20 according to second embodiment is same as poppet valve 20 according to first embodiment, but in order to discriminate it from second poppet valve 52, it is referred to as first poppet valve 20 in the second embodiment.

The second poppet valve 52 has the same structure as the first poppet valve 20, that is, structure capable of metering with a check function, so the second poppet valve 52 is arranged at an upstream side of second stick spool valve 53, i.e. in a supply oil passage from second hydraulic pump 12 to second stick spool valve 53. Also, the second poppet valve 52 is started by pilot pressure output from the poppet valve solenoid valve 56 based on the control signal output by the control unit 30 to the second poppet valve solenoid valve 56 to control supply flow rate from second hydraulic pump 12 to second stick spool valve 53. The supply flow rate supplied from the second poppet valve 52 to second stick spool valve 53 is, as mentioned later, configured to be supplied as-is to stick cylinder 9 without being increased or decreased by the second stick spool valve 53.

Figure 8A:
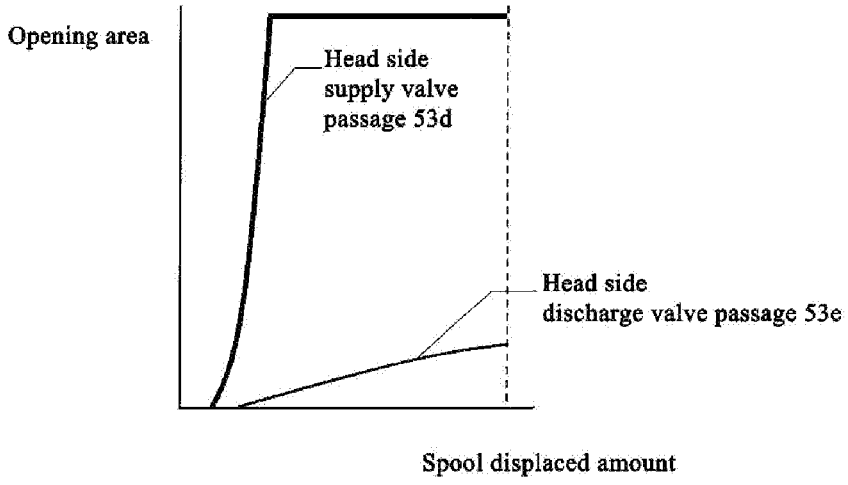
FIG. 8A illustrates its opening characteristics at in-side operation position.
Figure 8B:
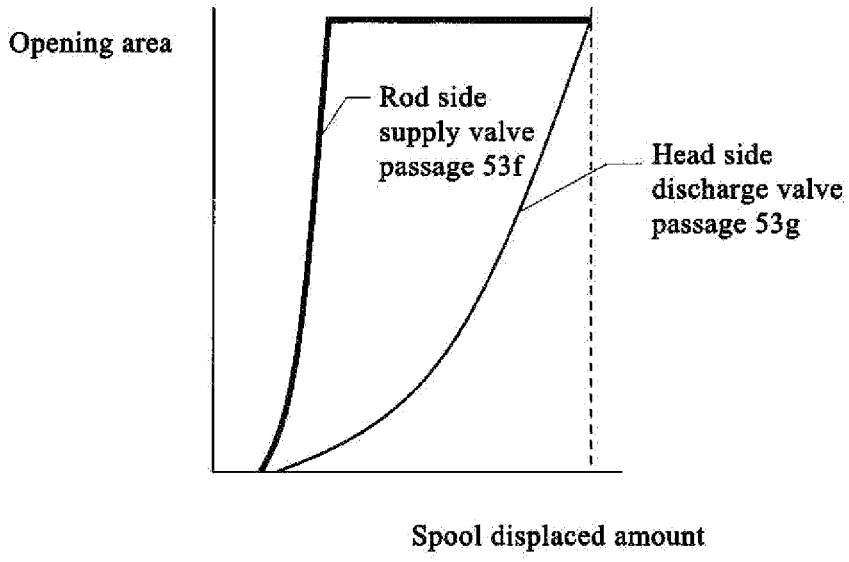
FIG. 8B illustrates its opening characteristics at out-side operation position.

Also, the second stick spool valve 53 is, similar to second stick spool valve 19 according to first embodiment, the three position change-over valve having in-side (extended side)

and out-side (contracted side) pilot ports 53*b*, 53*c*; wherein the neutral position N is switched to the in-side and out-side operation positions X, Y by inputting pilot pressure into in-side and out-side pilot ports 53*b*, 53*c*. Also, when the valve 53 is in the in-side operation position X, the head side supply valve passage 53*d* is opened for supplying delivery oil from second hydraulic pump 12 to head side oil chamber 9*a* of stick cylinder 9 and the rod side discharge valve passage 53*e* is opened for feeding discharge oil from rod side oil chamber 9*b* to oil tank 15. Meanwhile, when the valve 53 is in the out-side operation position Y, the rod side supply valve passage 55*f* is opened for supplying delivery oil from second hydraulic pump 12 to rod side oil chamber 9*b* and the head side discharge valve passage 55*g* is opened for feeding discharge oil from head side oil chamber 9*a* to oil tank 15; as shown in the FIG. 8, the opening characteristics of these head side supply valve passage 53*d* of second stick spool valve 53 according to second embodiment and rod side supply valve passage 53*f* are, similar to the opening characteristics of head and rod side supply valve passages 18*d*, 18*f* of first stick spool valve 18 according to first embodiment, configured so that the opening area is set to become maximum even when the spool's displaced amount is small. Thus, the second stick spool valve 53 is configured to supply the supply flow rate as-is from second hydraulic pump 12 supplied through second poppet valve 52 to head side and rod side oil chambers 9*a*, 9*b* of stick cylinder 9 without increasing or decreasing the flow rate. Note that, the opening characteristics of rod side and head side discharge valve passages 53*e*, 53*g* of second stick spool valve 53 according to second embodiment are the same as those of rod side and head side discharge valve passages 19*g*, 19*e* of second stick spool valve 19 according to first embodiment (refer to FIG. 8). Also, in FIG. 7, reference number 53*a* denotes a center bypass passage installed on second stick spool valve 53.

That is, according to the second embodiment, the second stick spool valve 53 connected to second hydraulic pump 12 is, similar to first stick spool valve 18 connected to first hydraulic pump 11, configured to supply the supply flow rate as-is controlled by second poppet valve 52 to stick cylinder 9 without controlling supply flow rate from second hydraulic pump 12 to stick cylinder 9. Then, when a stick-in or stick-out operation signal is input from the operation detection means 36, the control unit 30 outputs a control signal for outputting pilot pressure to second poppet valve solenoid valve 56, and in response to this, the second poppet valve 52 starts to supply delivery oil from second hydraulic pump 12 to second stick spool valve 53 while the delivery flow rate of the delivery oil is controlled. Thus, during the stick-in operation, second poppet valve 52 controls supply flow rate from second hydraulic pump 12 to head side oil chamber 9*a*. The second stick spool valve 53 at in-side operation position X is configured to control discharge flow rate from rod side oil chamber 9*b* to oil tank 15; during stick-out operation, the second poppet valve 52 is configured to control supply flow rate from second hydraulic pump 12 to rod side oil chamber 9*b*, and second stick spool valve 53 at out-side operation position Y is configured to control discharge flow rate from head side oil chamber 9*a* to oil tank 15.

Thus, according to second embodiment, the first poppet valve 20 controls supply flow rate from first hydraulic pump 11 to head side oil chamber 9*a* of the stick cylinder 9, the first stick spool valve 18 controls recycled flow rate from rod side oil chamber 9*b* to head side oil chamber 9*a*, the second poppet valve 52 controls supply flow rate from second hydraulic pump 12 to head side oil chamber 9*a* and the second stick spool valve 53 controls discharge flow rate from rod side oil chamber 9*b* to oil tank 15, so that the supply, recycled, and discharge flow rates can be controlled independently of each other. Meanwhile, during the stick-out operation, the first poppet valve 20 controls supply flow rate from first hydraulic pump 11 to rod side oil chamber 9*b*, the second poppet valve 52 controls supply flow rate from second hydraulic pump 12 to rod side oil chamber 9*b*, the first and second stick spool valves 18, 53 control discharge flow rate from head side oil chamber 9*a* to oil tank 15, so that the supply and discharge flow rates can be controlled independently of each other.

Thus, according to second embodiment configured above, the supply, discharge, and recycle flow rates for the stick cylinder 9 can be controlled independently of each other by making use of first and second stick spool valves 18, 53, so those according to second embodiment can produce the same effect as those according to the first embodiment mentioned above, and further, according to second embodiment, in addition to first poppet valve 20 arranged at upstream side of the first stick spool valve 18 for controlling supply flow rate from first hydraulic pump 11 to stick cylinder 9, the second poppet valve 52 is provided at an upstream side of second stick spool valve 53 for controlling supply flow rate from second hydraulic pump 12 to stick cylinder 9, so that the supply flow rate can be more accurately controlled.

Figure 9:
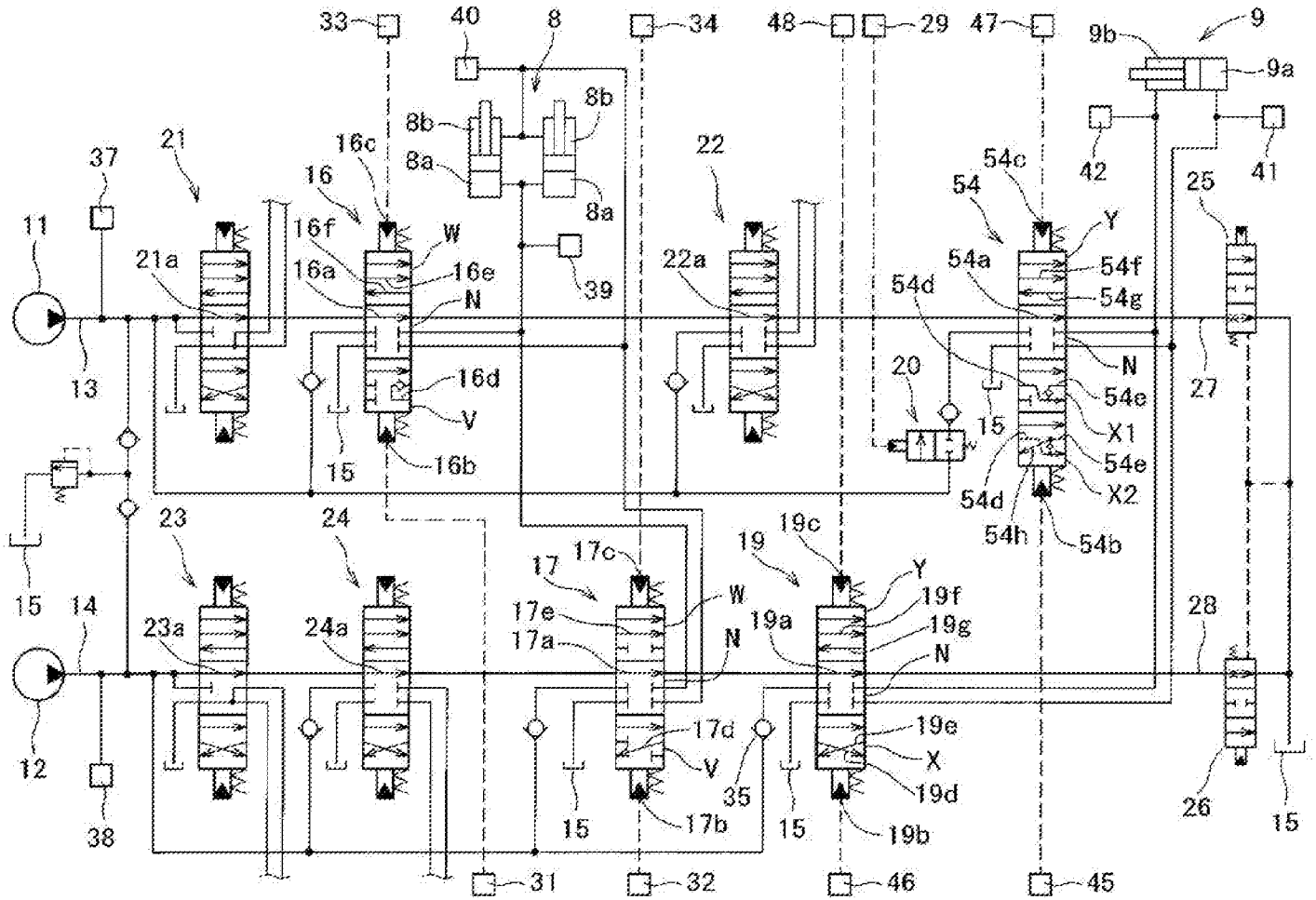
FIG. 9 is a hydraulic control circuit illustrating a third embodiment.

Next, third embodiment of the present invention is described in reference to hydraulic control circuit diagram shown in FIG. 9; since anything other than first stick spool valve 54 mentioned later is the same as first embodiment, an explanation is omitted about it.

First stick spool valve 54 according to the third embodiment comprises, similar to first stick spool valve 18 according to first embodiment, in-side and out-side pilot ports 54*b*, 54*c*, wherein the valve 54 switches from neutral position N to the in-side and out-side operation positions X, Y when the pilot pressure is input into in-side and out-side pilot ports 54*b*, 54*c*, wherein first and second areas X1, X2 are provided in the in-side operation position X of first stick spool valve 54 according to third embodiment. In this case, the spool displaced amount of second area X2 from neutral position N is set larger than that of first area X1. Then, when the valve 54 is positioned in first area X1, a head side supply valve passage 54*d* is opened for supplying the delivery oil through poppet valve 20 from first hydraulic pump 11 to head side oil chamber 9*a* of stick cylinder 9 and a recycle valve passage 54*e* is opened for supplying discharge oil from rod side oil chamber 9*b* to head side oil chamber 9*a*. Also, when the valve 54 is positioned in second area X2, the head side supply valve passage 54*d* and recycle valve passage 54*e* are configured to be opened, and in addition, a rod side discharge valve passage 54*h* is configured to be opened for feeding discharge oil from rod side oil chamber 9*b* to oil tank 15. Note that, in FIG. 9, the reference number 54*a* denotes a center bypass passage installed on first stick spool valve 54.

Figure 10A:
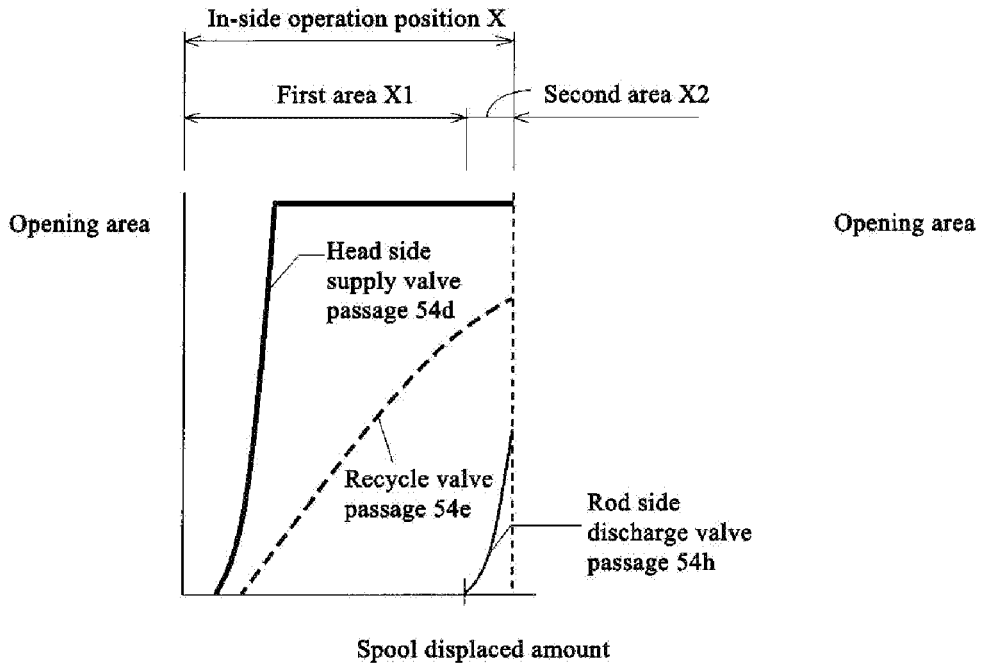
FIG. 10A illustrates its opening characteristics at in-side operation position.

Here, FIG. 10*a* illustrates opening characteristics of head side supply valve passage 54*d*, recycle valve passage 54*e* and rod side discharge valve passage 55*h* in first and second areas X1, X2 at the in-side operation position X; the opening characteristics of head side supply valve passage 54*d* and recycle valve passage 54*e* are the same as those of head side supply valve passage 18*d* and recycle valve passage 18*e* in in-side operation position X at the first stick spool valve 18 according to the first embodiment, and the opening characteristics of rod side discharge valve passage 54*h* is configured to be closed in first area X1 and have larger opening area just after entering into second area X2. Also, since the opening area of the rod side discharge valve passage 55*h* becomes larger soon, when the first stick spool valve 54 is positioned in second area X2, the valve passage 55*h* is configured to supply discharge oil from rod side oil chamber 9*b* quickly to oil tank 15.

Figure 10B:
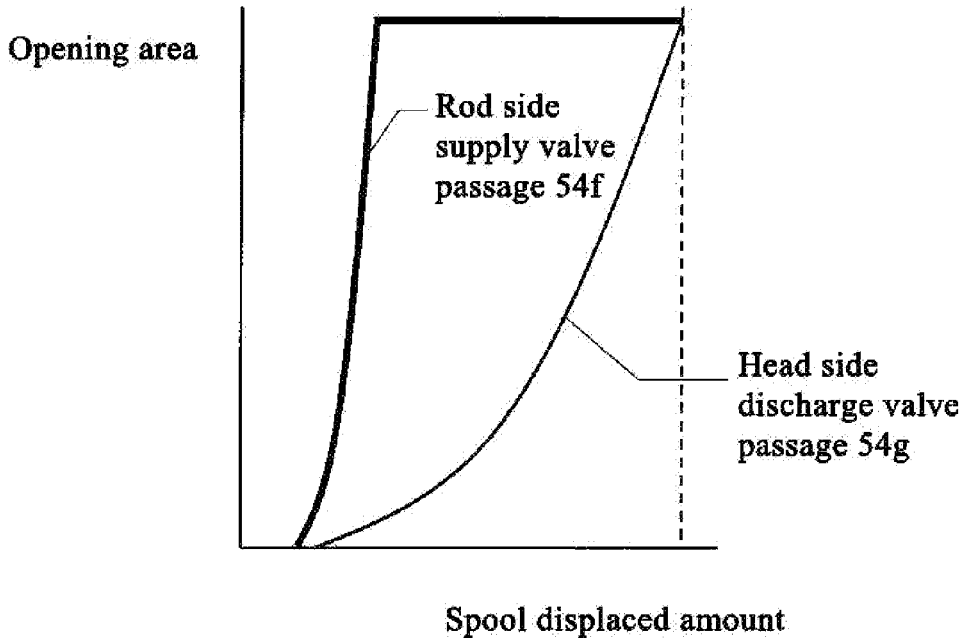
FIG. 10B illustrates its opening characteristics at out-side operation position.

Note that, when the first stick spool valve 54 according to third embodiment is in out-side operation position Y, similar to the case where first stick spool valve 18 according to first embodiment is in out-side operation position Y, the valve 54 opens rod side supply valve passage 54*f* for supplying delivery oil through poppet valve 20 from first hydraulic pump 11 to rod side oil chamber 9*b* and head side discharge valve passage 54*g* for feeding discharge oil from head side oil chamber 9*a* to oil tank 15; the opening characteristics of these rod side supply valve passage 54*f* and head side discharge valve passage 54*g* are configured to be the same as those of rod side supply valve passage 18*f* and head side discharge valve passage 18*g* of first stick spool valve 18 according to first embodiment (refer to FIG. 10*b*).

Meanwhile, the control unit 30 according to third embodiment determines, when a stick-in operation signal is input by the operation detection means 36, whether hydraulic oil can be recycled from rod side oil chamber 9*b* to head side oil chamber 9*a* based on a pressure in head side/rod side oil chambers 9*a*, 9*b* of stick cylinder 9 input by head side/rod side stick pressure sensors 41, 42. Here, when a pressure Pr in rod side oil chamber 9*b* is higher than a pressure Ph in head side oil chamber 9*a* (Pr>Ph), a recycle is determined possible, and when the pressure Pr in rod side oil chamber 9*b* is not higher than the pressure Ph in head side oil chamber 9*a* (Pr≤Ph), the recycle is deemed impossible. Note that, in third embodiment, the control unit 30 configures a judgment means for the present invention.

Furthermore, when a stick-in operation signal is input from operation detection means 36, similar to first embodiment, the control unit 30 outputs control signal to first and second in-side solenoid valves 45, 46 for outputting pilot pressure to switch first and second stick spool valves 54, 19 to in-side operation position X; in this case, when it is deemed possible to recycle hydraulic oil from rod side oil chamber 9*b* to head side oil chamber 9*a* (the pressure Pr in rod side oil chamber 9*b* is higher than the pressure Ph in head side oil chamber 9*a* (Pr>Ph)), the control unit 30 outputs control signal to the first in-side solenoid valve 45 to output the pilot pressure for positioning first stick spool valve 54 in first area X1 (spool displaced amount for entering into first area X1). Thus, the first stick spool valve 54 is positioned in first area X1 and opens head side supply valve passage 54*d* for supplying the delivery oil from first hydraulic pump 11 through poppet valve 20 to head side oil chamber 9*a* of stick cylinder 9 and opens recycle valve passage 54*e* for supplying discharge oil from rod side oil chamber 9*b* to head side oil chamber 9*a*.

Meanwhile, when an operation signal for stick-in operation is input from operation detection means 36 and when it is deemed impossible to recycle hydraulic oil from rod side oil chamber 9*b* to head side oil chamber 9*a* (the pressure Pr in rod side oil chamber 9*b* is not higher than the pressure Ph in head side oil chamber 9*a* (Pr≤Ph)), the control unit 30 outputs control signal to first in-side solenoid valve 45 to output the pilot pressure for positioning first stick spool valve 54 in second area X2 (spool displaced amount for entering into second area X2). Then, the first stick spool valve 54 is positioned in second area X2, keeps an opening of the head side supply valve passage 54*d* maximum for supplying the delivery oil through poppet valve 20 from first hydraulic pump 11 to head side oil chamber 9*a* of stick cylinder 9, opens the recycle valve passage 54*e* as well for supplying discharge oil from rod side oil chamber 9*b* of stick cylinder 9 to head side oil chamber 9*a*, and opens rod side discharge valve passage 54*h* for discharging discharge oil from rod side oil chamber 9*b* to oil tank 15. Note that, when the first stick spool valve 54 is positioned in second area X2, the recycle valve passage 54*e* is opened for supplying the discharge oil from rod side oil chamber 9*b* to head side oil chamber 9*a*, but, since the pressure Pr in rod side oil chamber 9*b* is not higher than the pressure Ph in head side oil chamber 9*a*, the oil is not recycled and the check valve provided in recycle valve passage 54*e* prevents a backflow (oil flow from head side oil chamber 9*a* to rod side oil chamber 9*b*).

As such, in third embodiment, when the hydraulic oil cannot be recycled from rod side oil chamber 9*b* to head side oil chamber 9*a* during stick-in operation (extension of stick cylinder 9), the first stick spool valve 54 is positioned in second area X2 and opens rod side discharge valve passage 54*h*. Thus, the discharge oil flows from rod side oil chamber 9*b* to oil tank 15 to reduce the pressure quickly in rod side oil chamber 9*b*, so that a working speed of stick cylinder 9 can be prevented surely from being damaged due to high pressure.

In addition, when the first stick spool valve 54 is positioned in first area X1 at in-side operation position X, similar to when the first stick spool valve 18 according to first embodiment is positioned in in-side operation position X, the poppet valve 20 controls supply flow rate from first hydraulic pump 11 to head side oil chamber 9*a*, and the recycle valve passage 54*e* with the first stick spool valve 54 controls the recycled flow rate from rod side oil chamber 9*b* to head side oil chamber 9*a*. Also, when first stick spool valve 54 is positioned in second area X2 at in-side operation position X, the poppet valve 20 controls supply flow rate from first hydraulic pump 11 to head side oil chamber 9*a*, the rod side discharge valve passage 54*h* with the first stick spool valve 54 controls discharge flow rate from rod side oil chamber 9*b* to oil tank 15 (as mentioned above, the hydraulic oil is not recycled from rod side oil chamber 9*b* to head side oil chamber 9*a*). That is, when the first stick spool valve 54 is positioned in first area X1 at in-side operation position X, the valve 54 is configured to control the recycled flow rate only, and also, when located in second area X2, the valve 54 is configured to control the discharge flow rate only. Furthermore, the first stick spool valve 54 sitting at out-side operation position Y controls, similar to when the first stick spool valve 18 according to first embodiment is positioned at out-side operation position Y, discharge flow rate only. Also, since the second stick spool valve 19 is similar to that of first embodiment, when located at in-side operation position X, the valve 19 controls supply and discharge flow rates from second hydraulic pump 12, and when positioned at out-side operation position Y, the valve 19 controls supply and discharge flow rates from second hydraulic pump 12. Thus, also in the third embodiment, the first and second stick spool valves 54, 19 can control the supply, recycle, and discharge flow rates independently of each other for stick cylinder 9, causing the same effect as the first embodiment.

Note that it is to be understood that the present invention is not confined to the first to third embodiments; for instance, both the first and second stick spool valves provided in each of the embodiments are a spool valve of pilot operated type changing with the pilot pressure; these first and second stick spool valves can be configured with a spool valve of electromagnetic proportional type where the control signal is directly input from control unit.

Also, according to third embodiment, second stick spool valve is similar to second stick spool valve 19 according to first embodiment, but it can be similar to second stick spool valve 53 according to second embodiment. If this is the case, the second poppet valve 52 similar to that of second embodiment is arranged at upstream side of the second stick spool valve 53.

INDUSTRIAL APPLICABILITY

The present invention can be used in a hydraulic control circuit for construction machines such as hydraulic excavator comprising the stick swingably supported at an end part of the boom.

The invention claimed is:

1. A hydraulic control circuit for a construction machine, comprising: a boom being vertically movably supported by a body and a stick swingably supported at an end part of the boom; first and second hydraulic pumps configured to swing the stick in dependence upon extension and contraction operations of a stick cylinder and used as hydraulic supply source; and first and second stick spool valves being connected respectively to the first and second hydraulic pumps; wherein, a poppet valve is provided at an upstream side of the first spool valve for controlling a poppet valve supply flow rate from the first hydraulic pump to the first stick spool valve, the first stick spool valve is configured to supply hydraulic flow to the stick cylinder without increasing or decreasing the poppet valve supply flow rate from the poppet valve, and when the stick cylinder is extended, the poppet valve is configured to control the poppet valve supply flow rate from the first hydraulic pump to a head side oil chamber of the stick cylinder, the first stick spool valve is configured to control a recycled flow rate from a rod side oil chamber of the stick cylinder to the head side oil chamber, the second stick spool valve is configured to control a second stick spool valve supply flow rate from second hydraulic pump to the head side oil chamber of the stick cylinder and a second stick spool valve discharge flow rate from the rod side oil chamber to an oil tank.

2. The hydraulic control circuit for construction machine of claim 1, wherein, when the stick cylinder is contracted, the poppet valve is configured to control the poppet valve supply flow rate from the first hydraulic pump to the rod side oil chamber of the stick cylinder, the first stick spool valve is configured to control a first stick spool valve discharge flow rate from the head side oil chamber of the stick cylinder to the oil tank, the second stick spool valve is configured to control the second stick spool valve supply flow rate from second hydraulic pump to the rod side oil chamber of the stick cylinder and the second stick spool valve discharge flow rate from the head side oil chamber to oil tank.

3. The hydraulic control circuit for a construction machine of claim 1, providing a means to determine whether it is possible to recycle hydraulic oil from rod side oil chamber to head side oil chamber based on a pressure in rod side and head side oil chambers during an extension of stick cylinder, wherein, when the first stick spool valve it is determined impossible to recycle hydraulic oil by the determination means, the first stick spool valve is configured to control discharge flow rate from rod side hydraulic chamber to oil tank.

4. The hydraulic control circuit for construction machine of claim 1, comprising first and second bypass valves respectively controlling a flow rate of first and second bypass oil passages for feeding delivery oil of the first and second hydraulic pumps to oil tank.

5. A hydraulic control circuit for a construction machine, comprising: a boom being vertically movably supported by a body and a stick swingably supported at an end part of the boom; first and second hydraulic pumps configured to swing the stick in dependence upon extension and contraction operations of a stick cylinder and used as hydraulic supply source; and first and second stick spool valves being connected respectively to the first and second hydraulic pumps; wherein, first and second poppet valves are provided at an upstream side of the first and second stick spool valves for controlling a poppet valve supply flow rate from the first and second hydraulic pumps to the first and second stick spool valves, the first and second stick spool valves are configured to supply hydraulic flow from the first and second poppet valves to the stick cylinder without increasing or decreasing the poppet valve supply flow rate from the first and second poppet valves, and when the stick cylinder is extended, the first and second poppet valves are configured to control the poppet valve supply flow rate from the first and second hydraulic pumps to a head side oil chamber of the stick cylinder, the first stick spool valve is configured to control a recycled flow rate from a rod side oil chamber of the stick cylinder to the head side oil chamber, the second stick spool valve is configured to control a second stick spool valve discharge flow rate from the rod side oil chamber of the stick cylinder to an oil tank.

6. The hydraulic control circuit for construction machine of claim 5, wherein, when the stick cylinder is contracted, the first and second poppet valves are configured respectively to control the poppet valve supply flow rate from first and second hydraulic pumps to the rod side oil chamber of the stick cylinder, the first stick spool valve is configured to control a first stick spool valve discharge flow rate from the head side oil chamber of the stick cylinder to the oil tank, and the second stick spool valve is configured to control the second stick spool valve discharge flow rate from the head side oil chamber of the stick cylinder to oil tank.

* * * * *